US009284778B2

(12) United States Patent
Rittmann

(10) Patent No.: US 9,284,778 B2
(45) Date of Patent: Mar. 15, 2016

(54) LADDER TOP END SUPPORT WITH PLATFORMS

(76) Inventor: Jean V. Rittmann, Everett, WA (US)

( * ) Notice: Subject to any disclaimer, the term of this patent is extended or adjusted under 35 U.S.C. 154(b) by 929 days.

(21) Appl. No.: 13/092,375

(22) Filed: Apr. 22, 2011

(65) Prior Publication Data

US 2012/0266436 A1 Oct. 25, 2012

(51) Int. Cl.

| | |
|---|---|
| ***B21D 39/00*** | (2006.01) |
| ***E06C 1/34*** | (2006.01) |
| ***E06C 7/14*** | (2006.01) |
| ***E06C 7/48*** | (2006.01) |

(52) U.S. Cl.
CPC .... *E06C 7/48* (2013.01); *E06C 7/14* (2013.01)

(58) Field of Classification Search
USPC ..... 29/428; 182/107, 108, 129, 230; 248/210, 238
See application file for complete search history.

(56) References Cited

U.S. PATENT DOCUMENTS

| | | | | |
|---|---|---|---|---|
| 4,277,035 A | | 7/1981 | Gaski | 242/404.3 |
| 4,469,193 A | * | 9/1984 | Rumsey, Jr. | 182/22 |
| 4,823,912 A | * | 4/1989 | Gould et al. | 182/214 |
| 5,123,620 A | * | 6/1992 | Bourne | 248/210 |
| 5,901,998 A | * | 5/1999 | Gallo, Jr. | 294/143 |
| 5,950,972 A | * | 9/1999 | Irish | 248/210 |
| 6,328,130 B1 | * | 12/2001 | Smith | 182/107 |
| 6,354,401 B2 | * | 3/2002 | Murray | 182/214 |
| 6,401,862 B1 | * | 6/2002 | Caron | 182/129 |
| 6,443,260 B1 | * | 9/2002 | Katz et al. | 182/129 |
| 6,467,577 B1 | * | 10/2002 | Charlebois, Jr. | 182/129 |
| 6,878,007 B1 | | 4/2005 | Decker | 439/369 |
| 6,880,794 B1 | | 4/2005 | Kahn | 248/315 |
| 8,523,098 B2 | | 9/2013 | Detweiler | 242/404.3 |
| 8,616,912 B1 | | 12/2013 | Vendura | 439/368 |

* cited by examiner

*Primary Examiner* — Jermie Cozart

(57) ABSTRACT

A method to horizontally support substantially parallel railed ladder (3) with box (4) against vertical surface (17), with ladder footed (5) on horizontal ground (6). Box substantially has front side (32) open, facing ladder. Ladder top end (2) supports against box uppermost portions (36), ladder lower upper portion (94) supports against box bottom wall front portions (13), and box back side (11*b*) supports substantially flat against the vertical surface. Box top wall (10) and bottom wall (12) are both substantially perpendicular to the box back side. Ladder leans at a substantial angle, substantially at 4-up-to-to-1-out angle (U to O angle). Box on ladder can: provide two platforms to place supplies laddertop; distance ladder from the vertical surface; and improve ladder utility and user safety.

17 Claims, 11 Drawing Sheets

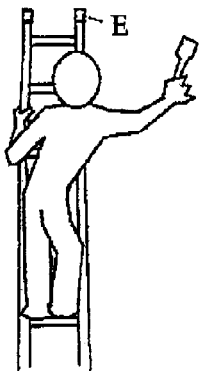
Prior Art Fig. 1a
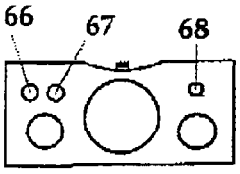
Prior Art Fig. 4
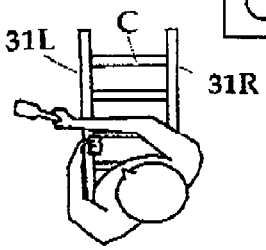
Prior Art Fig. 1b
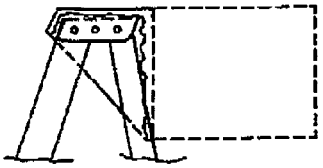
Prior Art Fig. 3a
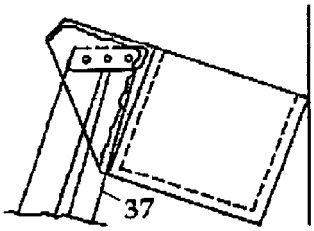
Prior Art Fig. 3b
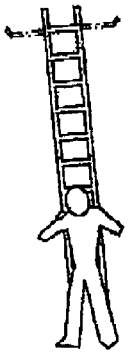
Prior Art Fig. 1f
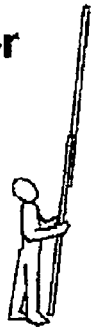
Prior Art Fig. 1c
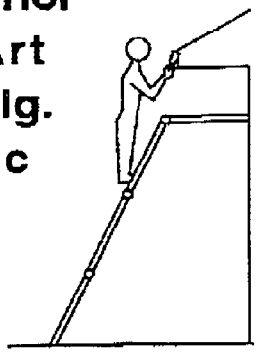
Prior Art Fig. 2
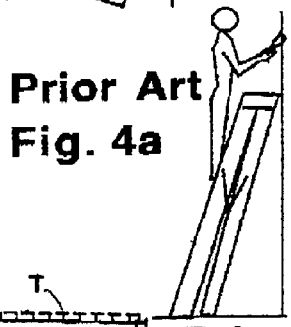
Prior Art Fig. 4a
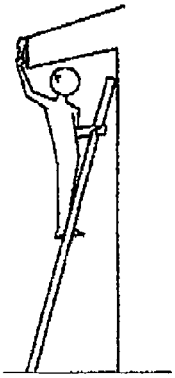
Prior Art Fig. 1d
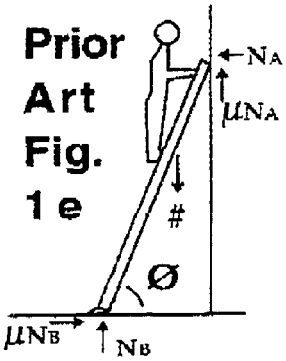
Prior Art Fig. 1e
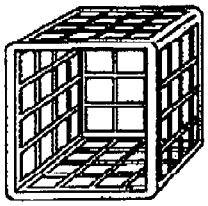
Prior Art Fig. 5a
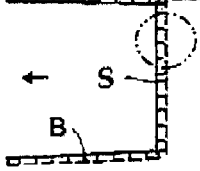
Prior Art Fig. 5b
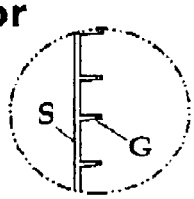
Prior Art Fig. 5c

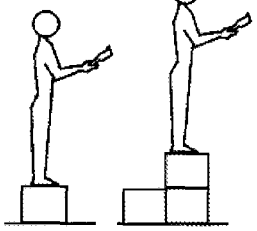
Fig. 7a
Fig. 7b
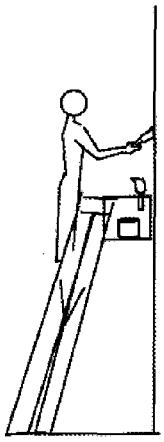
Fig. 7c
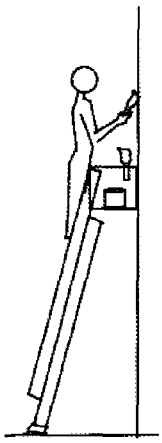
Fig. 7d
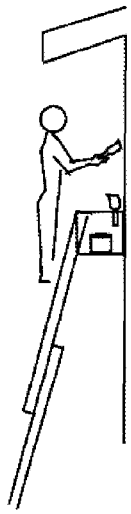
Fig. 7e
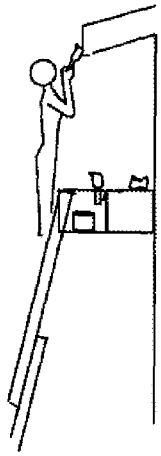
Fig. 7f
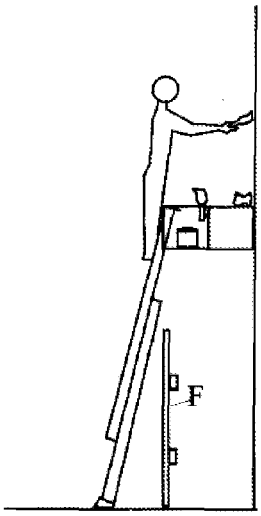
Fig. 7g
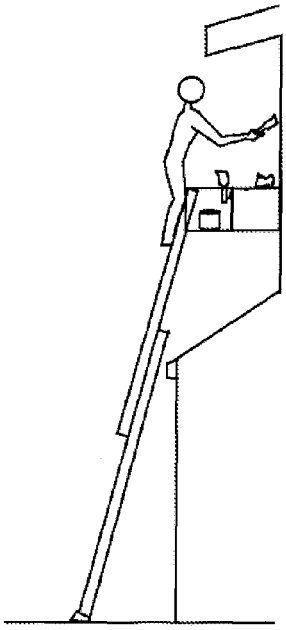
Fig. 7h
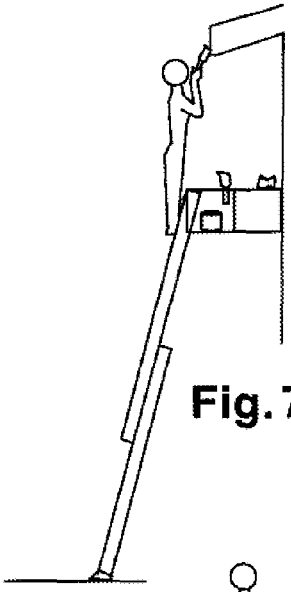
Fig. 7i
P.A.Fig. 7ha
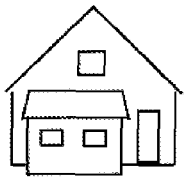
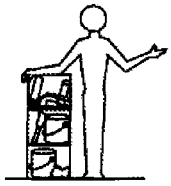
Fig. 7j

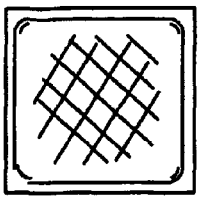
Fig. 8
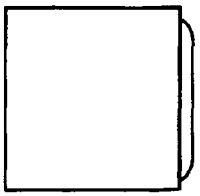
Fig. 9
Fig. 10c1
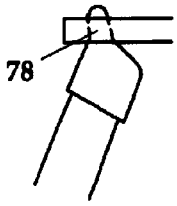
Fig. 10a
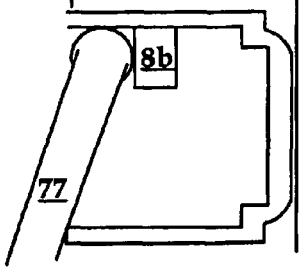
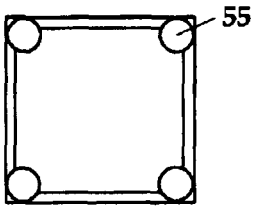
Fig. 8a
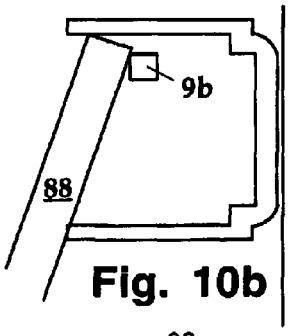
Fig. 10b
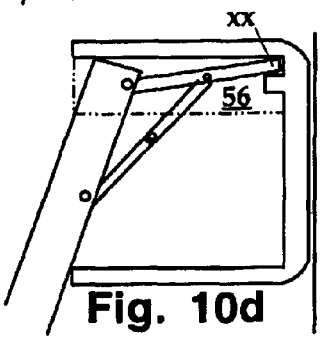
Fig. 10d
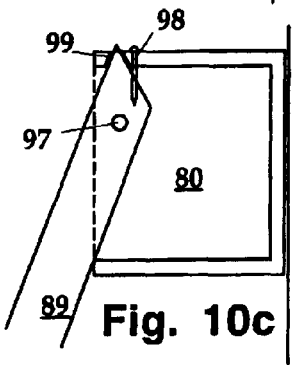
Fig. 10c
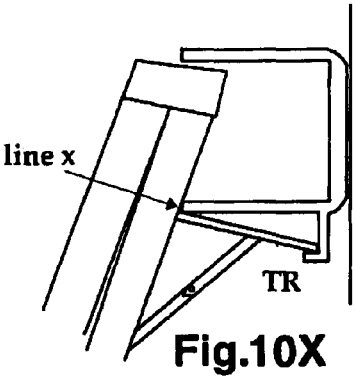
Fig.10X
Fig. 11b
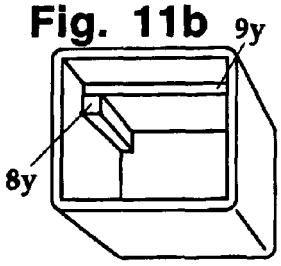
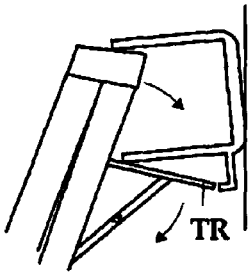
Fig. 10Xa
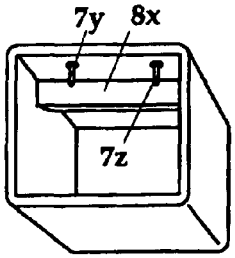
Fig. 11a
Fig. 11c
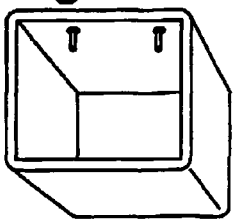

Fig. 12
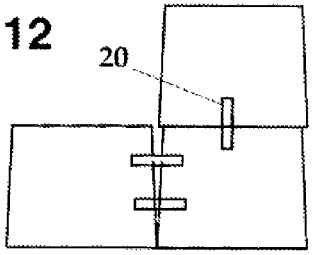
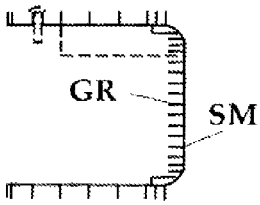
Fig. 13
Fig. 14a
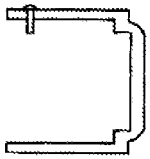
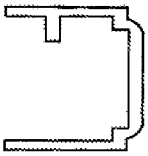
Fig. 14b
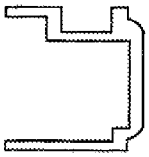
Fig. 14c
Fig. 14d
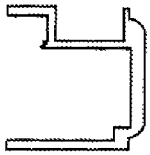
Fig. 14e
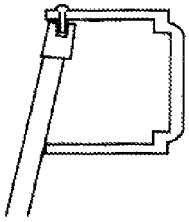
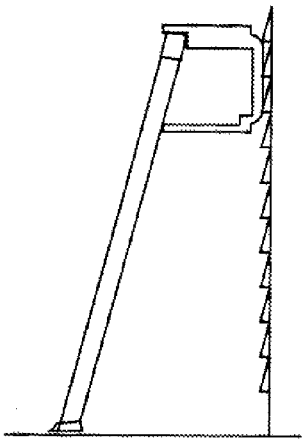
Fig. 15a
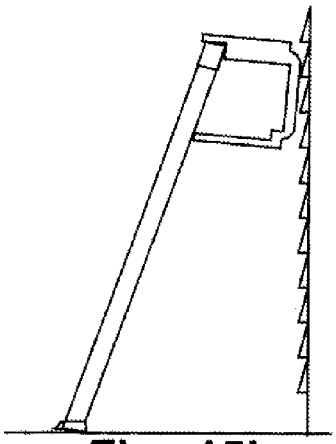
Fig. 15b
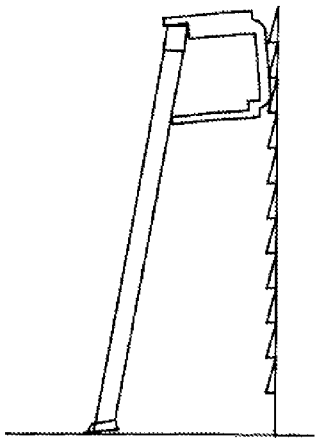
Fig. 15c
Fig. 16
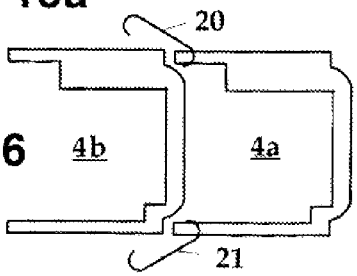
FIG. 17
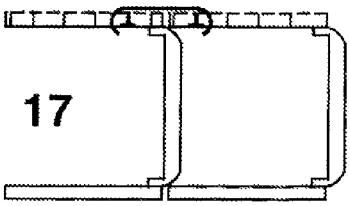

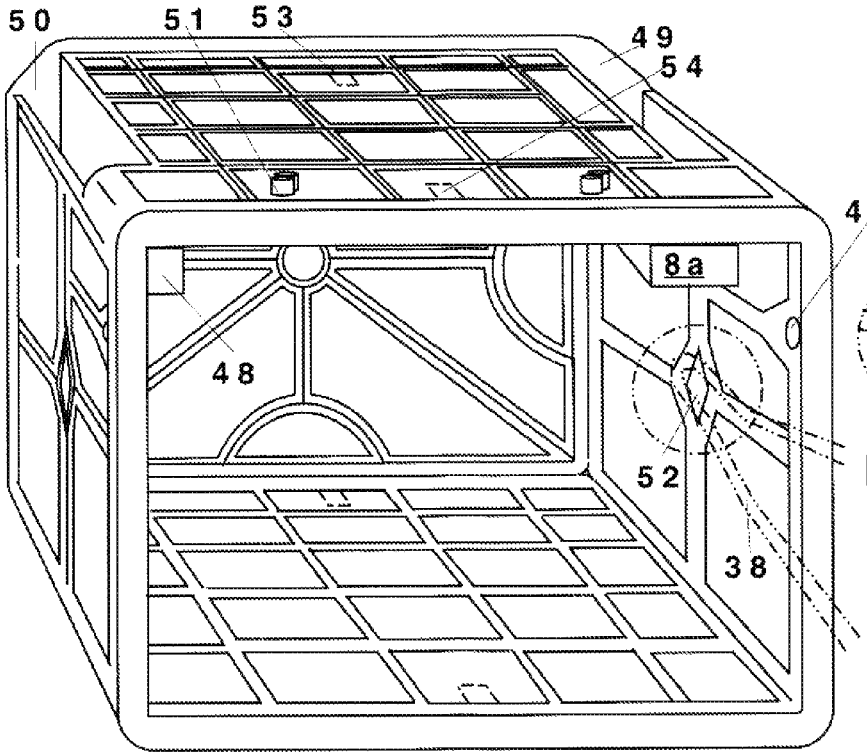
Fig. 18
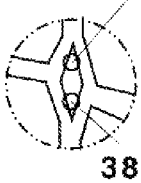
Fig. 18a
Fig. 36a
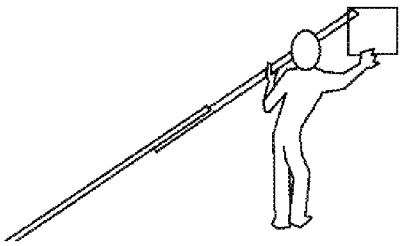
Fig. 36b
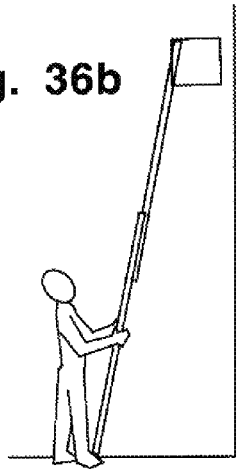
Fig. 36c
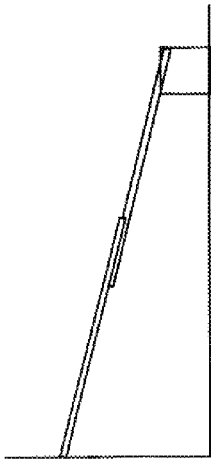

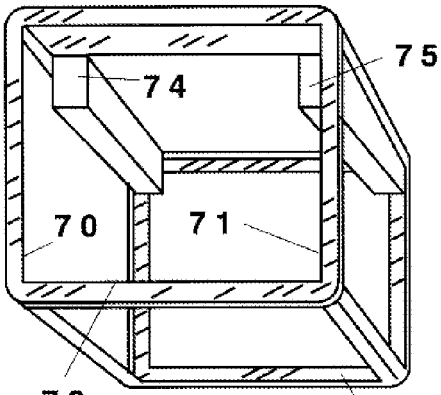
Fig. 23
Fig. 24
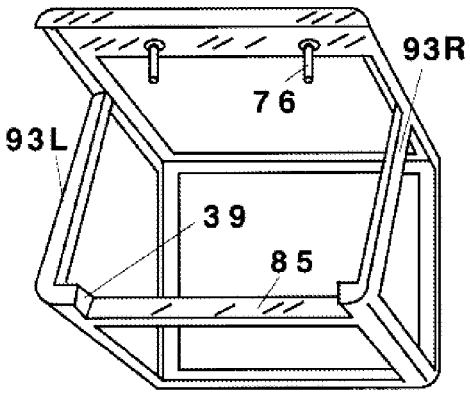
Fig. 23a
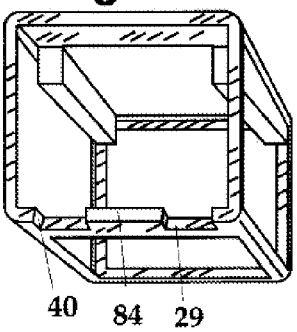
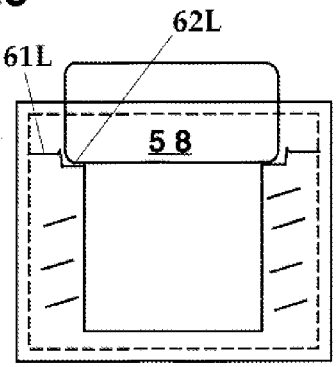
Fig. 26a
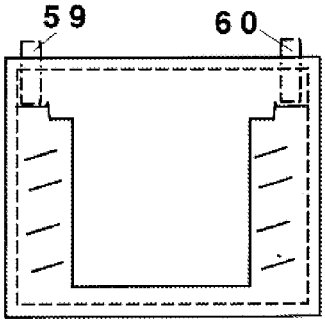
Fig. 27a
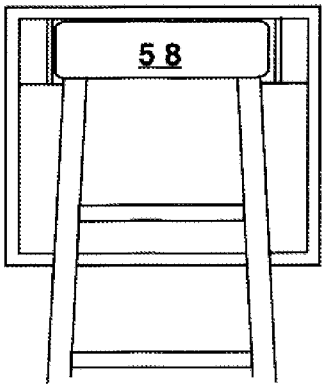
Fig. 26b
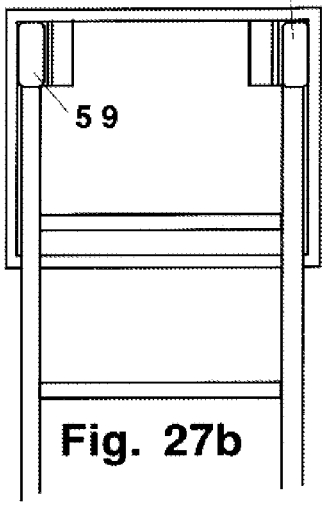
Fig. 27b
Fig. 25
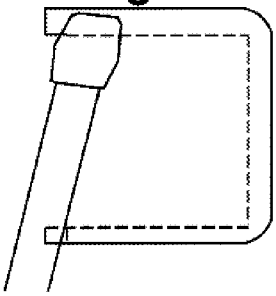

LADDER TOP END SUPPORT WITH PLATFORMS

CROSS-REFERENCE TO RELATED APPLICATIONS

This application claims priority of Provisional Application No. 60/714,446, file date: Sep. 6, 2005, application Ser. No. 11/512,959, and matter disclosed in Amend. dated Oct. 29, 2010, all by inventor Jean V. Rittmann

STATEMENT REGARDING FED. SPONSORED RESEARCH OR DEVEL.

Not Applicable

REFERENCE TO A MICROFICHE APPENDIX

Not Applicable

BACKGROUND OF INVENTION

This invention relates to fire escape, ladder, or scaffold. More specifically, platform with ladder as support. More specifically to standoffs: device including means to su ort the ladder away from the surface against which it leans or rests.

Ladders of issue include one-fold A-frame folding ladders, straight ladders (slide or unfolding), and scaffold ladders, including pivotally connected ladders. Many such ladders are for building, repairing, painting and the like of vertical walls/surfaces, and surfaces near such vertical surfaces. Accessories for ladders include trays, (for supplies) and stabilizing supports.

Each ladder type has disadvantages. One-fold folding A-frame ladders have limited height, need sure footing for all four legs, & need a substantially level surface to correctly unfold its A frame. They have nearly no room for painting supplies and the like on the ladder platform. Inside floors provide for such secure footing, but outside ground can be uneven (like 2 legs on the sidewalk and two legs in the garden area abutting/near the building.

Straight ladders have disadvantages. To work on a vertical surface a user steps many steps down form the top of a ladder to be at a distance horizontally away from the vertical surface. Prior Art FIG. 1*a* is a sketch of a user painting on a ladder, front view. It shows the user cannot work much directly in front of them much because the ladder is in the way. By painting to a user's side, a user counterbalances themselves sideways against the ladder, which is a stressful position for a user, can dig into the wood by the sideways rubbing of the ladder's top end, and can unbalance the ladder. (It's an OSH "don't"). ["OSH" in this Specification refers to U.S. Federal law entitled Occupational Safety and Health Act of 1970 (OSH Act)] Ladder-top friction pads and accessory side supports are available to sideways-stabilize a ladder. But side supports make the ladder more top-heavy, harder to balance when moving, can't get close to corners, take time to attach, and still provide no place to support supplies near ladder top end.

A straight ladder is often 16 inches wide, and a user's arm can extend sideways an average of 2 to 2.5 feet, plus brush length. Most users paint with their favored hand, to do a good job. Prior Art FIG. 1*b* is a sketch of a user painting on a ladder, top view. It shows that, because the ladder crosses in front of a user's chest, it is nearly impossible to paint on the users non-favored side of the ladder. That means that a straight ladder would have to be re-positioned every one to 1.5 feet sideways. This becomes more involved when a user is working on a roof-pitched vertical surface, where the needed ladder height changes with the roof pitch height.

Prior Art FIG. 1*c* shows right hand side view of a user moving a ladder. (In this Specification, RHS is the abbreviation for right hands side.) Prior Art FIG. 1*f* shows front view of a user moving a straight ladder. Phantom lines show a prior art standoff. As depicted in drawings, straight ladders are tall such that most of their weight is above a persons arm level. The weight above arm/grabbing level often includes a ladder-portion overlap. When picked up and moved, straight ladders must be levered and balanced into place. This can be dangerous. Moving such a ladder can damage vertical surfaces when unbalanced, or the ladder can fall or be dropped before it is secured in place. Sliding a ladder vertically taller, either by hand or mechanism, still has the balancing problem to secure against a vertical surface. Additionally, any tray for supplies would best be attached after the ladder is erected, to prevent a more top-heavy condition when moving. So not only must a straight ladder be moved often because a user can only paint to the side, but any tray may need to be removed with every move. Prior art trays, often flat, provide little security against spillage or dropping if accidentally bumped. This often means limited supplies near the top of a ladder. Without much security for supplies, many users, doing more than just painting, haul supplies up and down the ladder several trips before ladder must be moved. Climbing up and down a ladder is not fun, always includes the possibility of a potential fall, and is time consuming. Standoffs (phantom lines in Prior Art FIG. 1*f*), hold the ladder back from the vertical surface like 10", but is 4' wide, so cannot mount everywhere, like close to windows, and roof pitch. Standoffs also cannot get right to the corner of a house (like for painting corner overhangs).

Straight ladders with and without standoffs have nowhere to mount a paint can or tool. When tools or paint cans are hung off the side of the ladder, that places an unbalanced weight sideways on the top part of the ladder. Both leaning to the side and having weight to one side is a common cause of a user on a ladder falling down sideways.

On exterior vertical surfaces, may buildings have eves which must be worked on. As eves overhang the vertical surfaces, a straight ladder is often not tall enough for a user to work on the eves without leaning back. This is shown in Prior Art FIG. 1*d* is a sketch of a user painting a truss, side view. Many hold onto an eve structure, like an overhead truss. This is because one must step farther down the ladder to reach farther away from the supporting vertical surface. Leaning back can be dangerous. Holding on to an above-head structure, like a truss, is not a secure hold. Such a lean-back can cause a user to fall-fall from a high location. A user often puts the straight ladder in an almost vertical position to reach as high as possible. An already near-vertical ladder can lift off the vertical surface, and take a user down. Leaning a straight ladder against the gutters also does not provide access to working on the eves.

A ladder's force against a vertical surface, or horizontally-supporting structure, is calculated by equations for equilibrium. Referring to Prior Art FIG. 1*e*, a force analogy diagram:

$$\Sigma FX=0=NA-\mu NB$$

$$\Sigma FY=0=NA=\mu NA-\#$$

$$\Sigma MA=0=-\#(0.5L\cos\varnothing)+NB(L\cos\varnothing)-\mu NB(12\sin\varnothing)$$

OSH recommends footing the ladder 1 meter out for every 4 meters tall. Footing a ladder means placing/weighting the lower end of the ladder on substantially horizontal ground.

Exterior work has the benefit of ground and cement, both highly frictional surfaces (μNB).

ANSI does bottom slip test for a leaning/straight ladder. Angle 75.5°, load (200-300#)—3rd step down, plywood floor & vertical surface, 50# pull 1" above test surface. (75.5° is the 4 up to one out angle of lean.) A-frame folding ladders are not known to currently be ANSI specified for leaning against a vertical surface.

Pivotally-connected ladders have problems. U.S. Pat. No. 4,216,844 entitled FITTING FOR JOINTS OF LADDER SECTIONS, granted Aug. 12, 1980, by Klafs is an example of the locking joints that connect ladder sections for multi-ladders. The locking joints on these ladders must be fully and properly secured so they do not collapse, especially in use. The joints can easily rust, some say in just one year. (Likely because soft plating on joint parts rubs off when joints are rotated, which is aggravated by frequent use.) This rusting can prevent the joints from locking and/or unlocking. It can keep the ladder from unfolding or from fully folding the ladder back. Some users lay the ladder on the floor, stand on one section, and try to pry another section open or press it closed. A user's fingers can get cut up on the joints while trying to adjust/lock/unlock the joints or fold or unfold the ladder. When not properly locked, a ladder can collapse causing a fall. Many users find these problems frustrating enough to discontinue using such a ladder. (A homeowner who has fewer projects more often chooses a ladder that is simpler to use). Some pivotally-connected ladders may be assembled like an upside-down italic capital L, such that the ladder's top end is away from the vertical surface, which is desirous for working on trusses. Prior Art FIG. 2 is a sketch of a user on such an L-formed multi-ladder. This position places a substantial stress on the small-diameter joints. If a collapse occurs, a user could crash against the surface on which they work, then fall. Multi-ladders can have four 3' or 4' segments. A depicted 12' ladder could be made 9' tall and would stand 3' away from the vertical surface. This distance can not be made smaller. To the average eye, this L position does not look safe. As most user's arm is 2' to 2.5' long, the user cannot reach the vertical surface against which the ladder rests without leaning over, which adds further stress to the joints, and is not a comfortable position. Commonly, such an angle would be supported by a cross-bar. Such a bar is shown as notation 10 in U.S. Pat. No. 4,121,692 entitled LADDER TRAY, granted Oct. 24, 1978, by Morawski, FIG. 1; and as support 14 in FIG. 1 of U.S. Pat. No. 4,460,063 entitled STEP-LADDER WORK BENCH, granted Jul. 17, 1984, by Casada. A pivotally-connected ladder positioned like in Prior Art FIG. 2 has platform rungs (steps) which do not provide a surface by themselves for supplies. If a board were put over the horizontal rungs, supplies it would place additional stress on the joints, and still have no security from being bumped off.

Morawski's tray, as shown in his FIG. 2, has rubber feet 44 with a benefit detailed in specification P. 3, lines 22-32, which recites, "In order to improve the engagement between the frame 10 and the vertical surface . . . (legs with) resilient pads 44 formed of rubber . . . (are attached) so they may be replaced as they wear out". (friction/padding benefit)

U.S. Pat. No. 5,123,620 entitled ACCESSORY CONTAINER FOR LADDER, granted Jun. 23, 1992, by Bourne is an example of a container supporting against the rear portion of the back rails of a ladder. Bourne's FIG. 3 is redrawn here as Prior Art FIG. 3*a*. Prior Art FIG. 3*b* is Bourne's FIG. 3 invention on a leaning ladder. For his container to continue to support against the rear portion of the back rail of a ladder, its top edge would dig sharply into a vertical surface. Bourne does not provide, nor have a place for any rubber feet, like Morawski's feet 44, that might protect a vertical surface if the ladder was leaned with the container in place. Bourne's container teaches away from securing a ladder a distance from a vertical surface when leaned. Bourne's FIG. 3 (Prior Art FIG. 3) supports his box at two points against an OPEN A-frame, but his invention can't support an A-frame ladder at a leaned angle, whether the ladder is open OR closed. HI invention can't support on a ladder and have the box back side flat against a vertical surface. Applicant's invention supports better than the angular support of Casada's arm braces (FIG. 1, n. 14).

Often painting requires about a one or two-foot lift before using a ladder. Some users stand on what looks like a stool, but does not meet OSHA standards to be called a stool. An example is the 16" tall plastic SIDE TABLE #03937 by Syroco as seen on web site www.syroco.com. The surface area is a rough texture that is of benefit as a step stool but not so much as a table (rough surfaces collect dirt, and a recessed surface would better prevent slippage off a side table). Many purchasers of such items buy them to use them as a stool. They have 4 supporting feet, which is not often sure footing on outside ground which is rarely level.

Folding stools also have problems for use outside. Their small-diameter rod-like legs can sink into the ground. The stool steps are not deep, or their depth cannot be used without bumping ones chins. So the stool must be positioned just-so: away from an outside vertical surface such that one can balance on the balls of ones feet. Users may need to lean on the vertical surface they are painting. This may lead to transfer of paint or dirt between the user and the vertical surface.

Des. Pat. No. 340,773 entitled LADDER TOP, granted Oct. 26, 1993, by Bartnicki et al. shows a ladder top end with several through-and through holes for tools, and a round recessed platform portion of a size to support a quart of paint. Prior Art FIG. 4 is a sketch of his prior art ladder top end FIG. 1, top view. ladder top end holes 66, 67, and 68 are noted. These noted holes are located on the far side of the ladder top end, versus the larger two side holes which are on the ladder top end front side, closest to ladder steps.

A ladder top end surface design likely has to avoid being designed of a look to hold larger or more spillable objects than OSHA might allow. There is a narrow hook on the ladder back, of a size and shape to hang an object with a metal wire handle (plastic handles, like for spackle, don't fit on it). The only common item that could be hung from such a hook is a gallon can of paint (paint in quarts do not come with metal wire hangers). The hook is recessed into the ladder back, which allows the ladder to be leaned smoothly against a vertical surface, which shows the designer recognizes that a ladder is often leaned against a vertical surface. When a folding ladder is leaned against a vertical surface it is often leaned at an angle more severe than when opened as an A frame. This leaves the ladder top end tilted, versus being a level surface.

Many ladder manufacturers have through-and-through holes in their ladder top end. Manufacturers include Werner®, Husky®, & Green Bull™.

Prior Art FIG. 5*a* is a prior art plastic crate, top perspective view. Heavy-duty prior art milk crates are often of two sizes: 12"×12" I.D. top opening and 12"×18" I.D. top opening. Prior art plastic storage/file crates for home use are often 12.5"×14" I.D. Crates are of average 11" deep. Prior Art FIG. 5*b* is a prior art plastic crate, cross-sectional view. Top wall T and bottom wall B are substantially parallel, widening near the opening to let the core of the injection molded tool to pull out in the direction of the arrow. Often this is a 4 degree sidewall taper. The top and bottom wall are considered substantially parallel for this specification. The crate walls are made light-yet-strong substantially by spiked grid walls (like a honeycomb), perpendicular to the wall. All sections of an injection molded part must be the same thickness such that the plastic flows evenly into the mold. This is why even corners of the crate that take abuse are thin. A detail of Prior Art FIG. 5*b* is shown in Prior Art FIG. 5*c*, which shows smooth side S and spiked grids G. Plastic thicknesses are often about 2 mm., with at least some grade for ease of ejection. Prior art metal ribbon bands have also been added on a crate rim for strength. The interior surfaces of the crate are smooth so molded crates can be ejected from the tool. Smooth side S is also marked on Prior Art FIG. 5*b*. Prior art crates have the smooth side inside, and require the SIDES to be smooth inside in order to pull the core of the tool off the molded crate. Some prior art plastic crates are made with a percentage of glass fibers, added for strength. Plastic with glass fibers does not fill a mold well in narrow spaces, so crate walls are made thicker, requiring more plastic than a plastic crate with similar-strength grid walls. Also, glass fibers scratch the tool, reducing tool life.

The frame width near the base of prior art A-frame ladders is wider than near the top of same ladder. Most all ladders have steps/rungs 12" apart (top of rung to top of rung). The ladder top end/platform of prior art A-frame ladders is often 13" wide, and the top-most step/rung is one foot down. The ladder is often 14" wide at that top step. Straight ladders are often closer to 16" wide at the top, first cross-bar/rung (like first rung C in Prior Art FIG. 1*b*) is often 6" to 9" from the top of the ladder. Where an A-frame ladder has a top platform, aluminum and fiberglass straight ladder's top-most portions are often called end caps (notation E in Prior Art FIG. 1*a*). Older-style wooden straight ladders may not have any distinctive end cap, but when "end cap" is referenced, it is the uppermost portion of the ladder rails above the first cross bar. Straight or A-frame, the top of steps/rungs, or crossbars of a ladder are generally one foot down from each other. A-frame ladders often post, "do not stand above this point" on the first step down from the top platform. OSHA Quick Card Ladder safety tips states, "Do not stand on the three top rungs of a straight, single or extension ladder."

A straight ladder often has two sections that slide apart to extend or reduce the length of the ladder. These two sections are substantially vertically parallel to each other. This can be seen in the drawing of Prior Art FIG. 1*c*. When an A-frame ladder is folded closed, front and back ladder sections are also substantially vertically parallel to each other. This can be seen in the closed ladder of Prior Art FIG. 3*b*.

FIG. Prior Art 4*a* shows user with a closed prior art A-frame ladder against a surface, side view. OSHA Quick Card Ladder safety tips states, "Do not use a self-supporting ladder (e.g., step ladder) as a single ladder or in a partially closed position." An A-frame ladder can be made to pass slip test with footing and ladder top end design. The ANSI test is where dead weight is placed on the ladder and 50 pounds of force pushes outward at the base of a ladder that is sitting on sanded plywood. The ladder should not move more than 0.25".

A prior art cylindrical paint can has substantially an 8" diameter.

BRIEF SUMMARY OF THE INVENTION

A method of supporting a ladder with box together against a substantially vertical surface. Box is substantially rectangular, having front side open and facing ladder. Box front-most top portion supports/ mates with ladder top end. When ladder footed on horizontal ground and ladder with box are leaned against a vertical surface, top end of ladder supports horizontally against uppermost portions of the box, lower upper portion of ladder supports/braces horizontally against bottom portions of the box, and box back side supports horizontally and substantially flat against the vertical surface. Box top and bottom walls are substantially both perpendicular to box back side, for horizontal strength and use as platforms for supplies. Ladder leans substantially at the substantial angle recommended by a ladder regulatory agency. Box on ladder can distance ladder from the vertical surface, improving ladder utility and user safety.

Advantages of the Invention

Straight ladders, which tend to be much taller than A-frame ladders, are often needed to reach under eves. But because the straight ladder must fit on the vertical surface, eves cannot be reached, even if one straightens the ladder at a non-safe angle. The box extends the ladder's useful height. It provides 2 level shelves (one behind the ladder for safe storage). It provides a larger contact area against a vertical surface, and improved ladder safety. The box invention can just be thrown atop most straight (including closed A-frame) ladders. The box supports a ladder away from a supporting vertical surface, making the ladder function like a 3 to 6 foot taller ladder, yet without the upper rungs being obstructive in front. Two boxes fixedly attached together allows the ladder to function as an 8 to 12 foot taller ladder. The box(s) can be substantially lighter in weight than a ladder 4 to 12 feet taller. A user can reach higher areas without using a hard-to-balance, heavy, tall ladder. Areas of a building normally only accessible with scaffolding, or not accessible at all, can be worked on with ease. Eves can be worked on without leaning backwards. All painting can be done without dangerous leaning to the side. Because of level shelves (versus hanging a paint can on the side of a ladder) the ladder stays balanced, and isn't compromised sideways. Because the weight of the ladder above where a user picks it up is reduced, the user can more easily move and balance the ladder. Such improved ladder control reduces likelihood that the ladder will bump/ding siding, or fall and crash down on something or someone.

The box lets a user work on a vertical surface directly in front of them and to both sides. Comparatively, a straight ladder' rungs are in the way, preventing all but painting to a user's favored side, tilting the ladder which can cause a ladder to fall/slip sideways. Painting a vertical surface directly in front of a user is easier and can allow a user to paint with wide strokes for a smoother finish. The invention makes working in tight spaces easier, accessible, and less dangerous, like under a home's eves. That is, some places under eves cannot be reached if a tall ladder were leaned against a vertical surface. It reduces the chance a user would lean backwards to paint or work on eves, (leaning can instigate a fall). The box adds, or deepens and makes more level, a ladder's top platform, for holding supplies. The wide frictional surface against a vertical surface improves ladder stability, and helps prevent siding from being marred. Many supplies can be safely stored under the ladder platform. The invention can be easily lifted off. When the box is off it may be used as a short stand-on platform, or three may be fixedly attached to make a taller step stool/platform. A rounded-edged, soft frictional (like rubber) backside keeps the siding from getting dinged, keeps the ladder from shifting, and adds friction when used off the ladder as a platform or as steps. Often painting requires one and two-foot lifts before using a ladder. One box can be used as a platform, perhaps 11" high. As compared to balancing the balls of ones feet on a shallow step stool, the box as a platform supports the entire length of a users feet. When used indoors, or on smooth floor surfaces, frictional feet can be attached. Three boxes can be attached together like steps to make a really stable stool. When work, like painting, is finished, the box invention can be used to store supplies, like a prior art crate, and they can be stacked.

Most users, like homeowners, buy a simple A-frame, one-fold, all-purpose ladder. Sometimes they also get a small, like 20', straight ladder. They may occasionally need a taller ladder or a specialty ladder. But they often compromise safety by stretching or bending backwards as compared to buying a specialized ladder for a not-so-often task. Since one or more boxes may be purchased long after the original ladder purchase, a user is more likely to buy the boxes to finish their project, and they do not have to worry about storing them. The box invention provides a potentially inexpensive way for a user to safely complete their project. A box may be designed to fit on only specific ladders, allowing the box maker to steer users to their ladders. Or a box can be made to fit most ladders.

The box invention allows a user to stay balanced and the optimal distance from a vertical surface, for easy sanding, painting, repairing, and more. FIG. 7*a* through FIG. 7*i* are of a user painting, side view. Details of the male/female means of holding the ladder in that position are not drawn. These figures show steps to a comfortable, fast, and efficient paint job. FIG. 7*a* shows a user standing on one box. FIG. 7*b* shows a user standing on a three-box formation. FIG. 7*c* shows the user & closed A-frame ladder with one box attached. FIG. 7*d* shows the user & straight ladder with one box attached. FIG. 7*e* shows the user on a straight ladder with one box attached. FIG. 7*e* shows the user & ladder of FIG. 7*d* with one more box attached. FIG. 7*j* shows the user next to three boxes stacked for storage.

FIG. 7*g* shows a user painting high up on an exterior vertical surface of a building where a 6' fence is a few feet from the building. Where normally expensive laborious scaffolding would be required, two lackeys (plus the neighbor's permission) can do the job! FIG. 7*h* shows how two lackey boxes can paint a second floor exterior surface where there is a first floor extension or perpendicular roof line, like Prior Art FIG. 7*ha*, or like a front entrance-way. There regular scaffolding would not provide a method of access to paint or repair. Figure is drawn to scale: 6' user, 21' tall two-story house (extending 10'/floor) is drawn. Prior Art FIG. 7*ha* depicts such a house extension, front view. Similarly, if landscaping bushes, rockery, or the like are obstructions near the house, or ground is sloping, and more, using a lackey or two solves near any painting problem quickly and easily. A user can also lean their knees in against the ladder for more comfort and stability. Even rest their hands on top of the lackey. Actually, resting one's knees against the ladder is then comfortable, and can make painting more enjoyable.

BRIEF DESCRIPTION OF THE DRAWINGS

Prior Art FIG. 1*a* is a sketch of a user painting on a ladder, front view

Prior Art FIG. 1*b* is a sketch of a user painting on a ladder, top view

Prior Art FIG. 1*c* shows users moving a straight ladder, RHS view

Prior Art FIG. 1*f* shows user moving a straight ladder, front view

Prior Art FIG. 1*d* is a sketch of a user painting a truss, side view

Prior Art FIG. 1*e* is a force analogy diagram

Prior Art FIG. 2 is a sketch of a user on an L-formed multi-ladder

Prior Art FIG. 3*a* is Bourne's FIG. 3

Prior Art FIG. 3*b* is Bourne's FIG. 3 invention on a leaning ladder

Prior Art FIG. 4 is a sketch of a prior art ladder top end, top view

Prior Art FIG. 4*a* shows user w/ closed A ladder against a surface, side view Prior Art FIG. 5*a* is a prior art plastic crate, top perspective view Prior Art FIG. 5*b* is a prior art plastic crate, cross-sectional view Prior Art FIG. 5*c* is a detail of Prior Art FIG. 5*b*

FIG. 7*a* shows a user standing on one box, side view

FIG. 7*b* shows a user standing on a three-box formation, side view

FIG. 7*c* shows user & closed A ladder w/ one box attached, side view

FIG. 7*d* shows user & straight ladder w/ one box attached, side view

FIG. 7*e* shows a straight ladder with one box attached, side view

FIG. 7*f* shows user painting eves; ladder with 2 boxes attached, side view

FIG. 7*g* shows user & ladder with 2 boxes near fence obstruction, side view FIG. 7*b* shows user & ladder with 2 boxes near house extension, side view Prior Art FIG. 7*ha* depicts a house extension, front view FIG. 7*i* shows the user & ladder with 2 boxes attached, side view FIG. 7*j* shows the user next to three boxes stacked for storage, side view FIG. 8 is a box with a frictional, curved surface, back view FIG. 8*a* is a box with 4 feet, substantially rectangular, back view FIG. 9 is a box, side (not cross-sectional) view FIG. 10*a* is a box with plank, side view FIG. 10*b* is a box with a lower plank, side view FIG. 10*c* is a box with alternative attachment means, side view FIG. 10*c*1 shows upper post extension end caps FIG. 10*d* straight ladder with hinged-out male ends, side view FIG. 10X an A ladder with hinged-out paint tray, side view.

FIG. 10Xa is FIG. 10X, shifting, side view.

FIG. 11*a* is a box, perspective view

FIG. 11*b* is a box, perspective view

FIG. 11*c* is a box with posts, perspective view

FIG. 12 is a three box assembly, side view

FIG. 13 shows a possible grid pattern for a box, side view

FIG. 14*a* is the box of FIG. 11*c*

FIG. 14*b* is a box with plank

FIG. 14*c* is an with block extending the width of the box

FIG. 14*d* is the box of FIG. 11*b*

FIG. 14*e* is the box of FIG. 11 *d*

FIG. 15*a* shows a leaning ladder where box backside is vertical, side view

FIG. 15*b* ladder where box top corner touches vertical surface, side view

FIG. 15*c* ladder where box bottom corner touches v. surface, side view

FIG. 16 shows two boxes, positioned for attachment, side view

FIG. 17 shows two boxes attached with a clip, side view

FIG. 18 shows a box, front perspective view

FIG. 18*a* is a detail of FIG. 18

FIG. 4 ladder top end, top view FIG. 23 shows a bare frame box with blocks, front perspective view FIG. 23*a* shows a notched out bottom, front perspective view FIG. 24 shows a bare frame box with posts, front perspective view FIG. 25 ladder end cap locks into, box top wall, side, view FIG. 26*a* a box, top cross sectional view, with A-frame ladder FIG. 26*b* a box front view, w/ A-frame ladder FIG. 27*a* box top crosssectional view, w/ straight ladder FIG. 27*b* box front view, w/ straight ladder FIG. 36*a* shows a user mating a box and ladder top end, side view FIG. 36*b* shows a user leaning a ladder, side view FIG. 36*c* ladder supported against box, box against surface, side view

BRIEF DESCRIPTIONS OF THE NOTATIONS

Figure 6A:
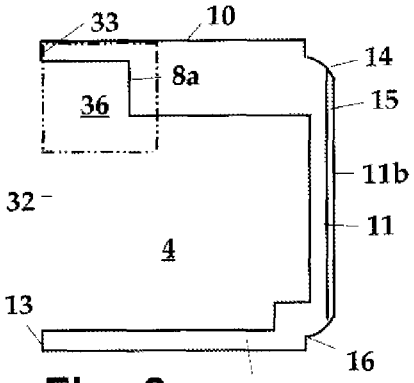
FIG. 6*a* is a box, cross-sectional view

| | | | |
|---|---|---|---|
| 1 | front side of an A- ladder | 51 | holes for when post is used |
| 1a | front side of straight ladder | 52 | a cord catch |
| 2 | ladder top end | 53 | a hole for clipping X together |
| 3 | an A- frame ladder's rails | 54 | a hole for a clip |
| 3a | a straight ladder's rails | 55 | a foot |
| 4 | a box | 56 | top portion |
| 4a | a box with clips | 57a | a restraining clip |
| 4b | a 2nd box | 57b | a restraining bungee cord |
| 5 | a ladder footed on ground | 57c | a restraining bungee cord |
| 6 | horizontal ground | 58 | a top end platform |
| 7x | a post | 59 | a straight ladder's LHS top end |
| 7y | a post | 60 | a straight ladder's RHS top end |
| 7z | a post | 61L | a surface |
| 8a | a RHS surface | 62L | surface |
| 8a1 | a RHS surface | 63 | rearward direction |
| 8b | a block | 65 | front-most top portion |
| 8x | a block | 66 | a prior art ladder top end hole |
| 8y | a block | 67 | a P.A. hole in a ladder top end |
| 9b | a plank | 68 | a P.A. hole in a ladder top end |
| 9y | a plank | 70 | a LHS edge |
| 10 | a box top wall | 71 | a RHS edge |
| 11 | a box back wall | 72 | a bottom edge |
| 11b | back side | 73 | a back surface |
| 12 | a box bottom wall | 74 | a LHS block |
| 13 | a bottom wall front portion/edge | 75 | a RHS block |
| 14 | a back wall curved edge | 76 | a post |
| 15 | an over molded area | 77 | a prior art ladder |
| 16 | a back wall shoulder | 78 | an post extension of an end cap |
| 17 | a vertical surface | 79 | box weighted down on ladder |
| 18 | back/rear side of ladder rails | 80 | a crate box |
| 20 | a clip | 81 | a plank |
| 21 | a clip | 82 | a RHS post hole |
| 27 | A- ladder lower upper portion | 83 | a LHS post hole |
| 28 | ladder lower upper portion | 84 | a center section |
| 29 | bottom wall front portion | 85 | bottom wall front portion |
| 30R | a ladder's RH outside side | 86 | a right-hand side wall |
| 30L | a ladder's LH outside side | 87 | a left-hand side wall |
| 31R | a ladder's RH outside side | 88t | upper portion of back wall |
| 31L | a ladder's LH outside side | 88b | lower portion of back wall |
| 32 | a box front/open side | 89 | a P.A. straight wood ladder |
| 33 | a box top wall front edge | 90 | a restraining rod |
| 34 | a post | 91 | a RHS block |
| 35 | a front edge | 92 | a LHS block |
| 36 | a box's uppermost portion | 93R | a crate right hand side "wall" |
| 37 | a post | 93L | a crate left hand side "wall" |
| 38 | a prior art folded cord | 94 | lower upper portion |
| 39 | an outside confining edge | 95 | a front restraint |
| 40 | an outside confining edge | 96 | frontward |
| 45 | a hole | 97 | a post |
| 48 | a LHS ladder surface | 98 | a post screw or pin |
| 49 | a RHS hollow bin | 99 | a box hole |
| 50 | a LHS hollow bin | | |
| C | first rung of a straight ladder | D | front-to-back depth |
| E | distance from vertical surface | | |
| F1 | line of force | F2 | line of force |
| F3 | line of force | F4 | line of force |
| G | exterior grating | S | a smooth side |
| GR | interior grating | P1 | a supply |
| E | an end cap of a straight ladder | P2 | a supply |
| L | a straight ladder | R1a | top rung of an A- ladder |
| xx | a hinged-out ladder extension | R2a | second rung of an A- ladder |
| line x | in-line-point of contact | R1b | top rung of a straight ladder |
| TR | a prior art paint tray | R1b | second rung of straight ladder |
| SM | a smooth box backside | W | width of an end cap |
| PL | upwards projected line | PL2 | upwards projected line |

DETAILED DESCRIPTION OF THE INVENTION

1. Description of a M/F and a F/M Ladder/Box Embodiment

All "Side Views" are Side Views of the Ladder (and User), but Cross-Sectional Views of the Box (in that Side Walls are not Drawn).

Figure 6E:
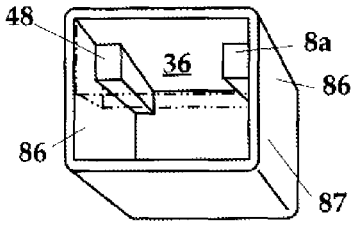
FIG. 6*b* box of FIG. 6*a* put on a P.A. A—ladder, side/x sectional view FIG. 6*bd* is a detail of the box of FIG. 6*b*
FIG. 6*c* is a box without any prop stop means, side/cross sectional view
FIG. 6*d* box of FIG. 6*a* put on a P.A. straight ladder, side/x sect. view FIG. 6*e* the box of FIG. 6*a*, front perspective view
FIG. 6*f* is a box on an A-frame ladder FIG. 6*fd* is a detail of the box of FIG. 6*f*

FIG. 6*a* is a box, cross-sectional view. Box 4 has top wall 10, back wall 11, bottom wall 12, front/open side/absent wall 32, and bottom wall front portion/edge 13. Box is substantially rectangular with substantially planular sides. For drawing ease, top, and bottom walls are shown as being exactly parallel. Since molded crates require about a 4% taper to pull box off tool, box top and bottom are considered for claims 'substantially parallel'. 8*a* is a RHS front surface, and 48 is LHS front surface. Together they are for horizontally supporting ladder top end. These front surfaces, together with front-most top portion 36, position substantially in the front uppermost portions (phantom line marked section 36 in FIGS. 6*a* and 6*e*) of the box, provide a female cavity to mate with (male) ladder top end. [This same box is shown in FIG. 6*e*, front perspective view, where 8*a* is noted, and RHS side wall 86 and LHS side wall 87 are noted.] Ladder top end will be supported within front-most top portion 36. Front edge of top wall 14 is a back wall curved edge, curved to keep the substantially rectangular back side 11*b*, at it's edges, from indenting a vertical surface like exterior siding. 15 is a back wall over molded area. Over molding (like neoprene or other rubber) provides benefits: Rubber is soft to not dent siding, provides friction against such a vertical surface to help prevent a ladder with box, like ladder top end 2 with box 4 in FIG. 6*b*, from shifting, and a frictional standing surface when the box is used as a stool. 16 is a back wall shoulder, for mating against/with another box bottom wall front portion (like this box's edge 13). Front edge of top wall 33 noted. Box 4's top wall 10 (and bottom wall 12) position substantially level, or horizontal, substantially each being a platform for supporting supplies. (Supplies are noted in FIG. 34 as supply P1 supported on upper/outside portion of top wall and supply P2 supported on inside/upper portion of bottom wall.)

Figure 6B:
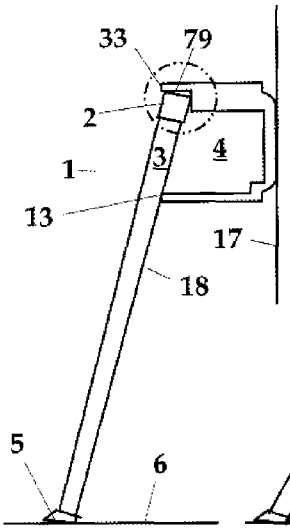

FIG. 6*b* is the box 4 of FIG. 6*a* put over the top (ladder top end 2) of a prior art ladder 3, side/cross sectional view. Ladder with box has the front/open side of the box facing towards the front side 1 of the ladder 3. The ladder is footed (5) on horizontal ground 6. The box with the female means (front surface 8*a*, other unseen surface 48, plus front-most top portion 36) together hold the male ladder's top end a distance away from the vertical surface 17 on which the ladder is leaned. In this embodiment, implemented front-most top portion is front portion of the box top wall. The box's back side rests substantially flat against/vertically against the shown vertical surface (like an exterior side of a house or building). Front-most top portion 65 of box 4 rests on ladder top end 2 (both rails, only one side shown). Substantially supporting box front-most top portion with ladder top end. Note the top wall front edge 33 of the box extends slightly over the front-to-back center of the ladder top end. A typical aluminum ladder has a 2.5" to 2.75" front-to-back rail width, with end caps width (marked by W in FIG. 6*bd*) slightly deeper. Some taller ladders have ladder rails/end caps were front-to-back deeper. To keep a substantial angle (OSH recommended 4-to-1 angle lean) of an even deeper ladder, the bottom wall front portion may have a notched-out segment, like 85: bottom wall front portion, in FIG. 24. That is because it is usually the front-side top corner of a ladder's top end that makes contact with the front-most top wall.

FIG. 6*bd* is a detail of FIG. 6*b*. FIG. 6*bd* also details the front surface 8*a* that supports the ladder from collapsing into the box. This surface can be smooth, or like this detail shows, have a frictional texture. Such a texture may reduce the play of the ladder against the front surface 8*a*. Substantially, ladder top end 2 (male) mates with box female (front-most top portion 36 plus front surfaces 8*a* and unseen 48).

Figure 6C:
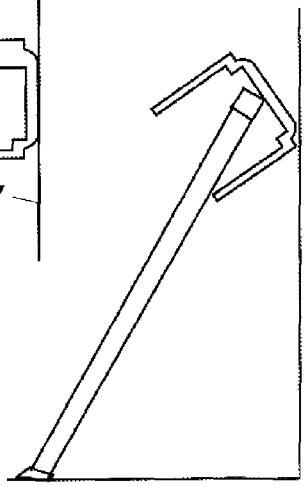

FIG. 6*c* is a box, substantially the same as box 4, but without any mating between ladder top end and box (no front surfaces), so no horizontal support. Though initially friction may keep a leaning ladder positioned as in FIG. 6*b*, with nearly any motion the ladder top end will collapse towards the supporting vertical wall. Though, in this position, the box still distances the ladder top end a bit away from the wall, the top edge of the box protrudes over the ladder's top step, obstructing a user from climbing up the ladder. The ladder is no longer at a recommended leaning angle, and top and bottom walls are no longer substantially horizontal for supporting supplies, supplies cannot be stored inside the box. And the box back side is no longer parallel/ flat against the vertical surface.

Figure 6F:
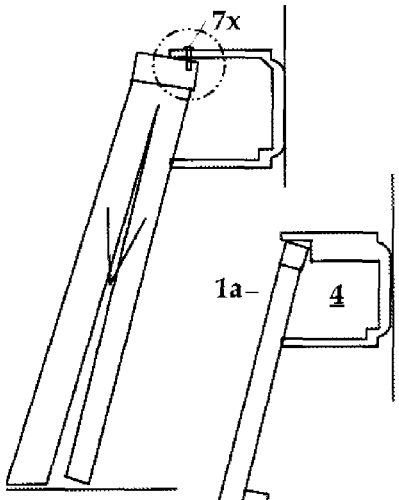
Figure 6D:
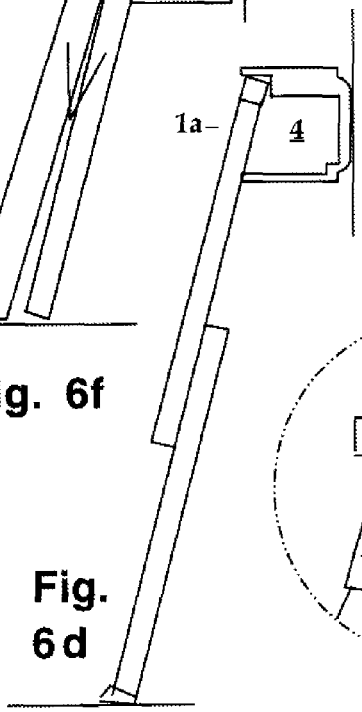
Figure 6B:
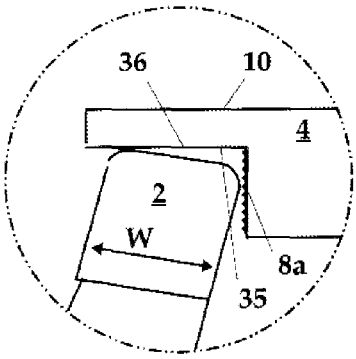
Figure 6F:
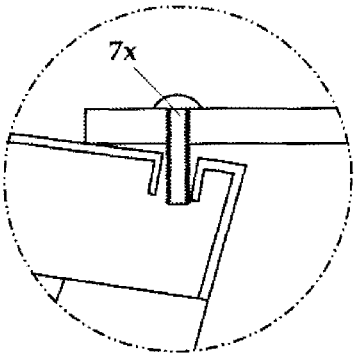

FIG. 6*d* is box 4 of FIG. 6*a* put on prior art straight ladder 1*a*, a 2-section ladder whose sections slide vertically taller from each other, side/ cross-sectional view. Most straight ladders are two section ladders. Many drawings in this specification show only one section to simplify drawing. FIG. 6*f* is a box on a closed A-frame ladder, where rails in that closed state are substantially parallel. Posts like post 7*x* support the ladder from collapsing horizontally towards the vertical surface, keep ladder from shifting sideways, and these posts also keep the ladder from moving frontward off the box, like when ladder is moved. FIG. 6*fd* is a detail of FIG. 6*f*. Notation 7*x* is a post (opposite post not seen). The posts may be made with prior art bolts screwed into vertical female-threaded locations on the top side of the box. This prior art A-frame ladder has ladder top end holes (like those shown in Prior Art FIG. 4). Post 7*x* (male) positions inside one prior art A-frame ladder top end hole (female), positioned substantially to the ladder's right side. A second unshown box post positions inside and opposite-side prior art ladder top end hole. Note that the post is positioned in a hole substantially at the back portion of the ladder top end. Posts are of a smaller diameter than the prior art ladder top end hole in which it is positioned, so the posts fit in hole even at the angle of lean. Posts, like post 7*x* can have a high-friction surface, like a bolt's threads, which help grab the ladder top end. This reduces any lifting of the box on the ladder top end by a user moving around on the ladder. In other words, a pair of female ladder top holes support against and mate with a pair of male posts (like 7*x*) of the box.

Possible holes are like in Prior Art FIG. 4 holes 66, 67, and opposite-side hole 68. If at least two opposite-side posts are used in a box, a front surface (like plank 8*a* shown in FIG. 6*a*), or any other front surface, is not needed. Front of surface 8*a* may be used in conjunction with other male/female means. Male/female support are a means to horizontally support a leaning ladder's ladder top end away from a vertical surface against which the ladder with box leans.

As a leaning ladder is to pass the ANSI Bottom Slip Test, a closed A-frame ladder would require footing that could pass that test. Such footing is not part of this specification. However, a box can reduce slip due to its expansive and/or frictional surface against the vertical surface.

Both embodiments of 6*b* and 6*f* have the box weighted down/supported on the ladder. That is, front-most top portion holds down on ladder top end by gravity/weight of the box. So, ladder top end supports box front-most top portion. The box is further held in place by vertical weight of ladder with box against a vertical surface, and by lower upper portion of ladder against front portion of box bottom wall.

FIG. 8 is a box with a frictional, substantially rectangular, curved cornered surface, back view. This back side surface may be a rough, smooth, or frictional rubber-like surface. It could be the back side of box 4 of FIG. 6*a*.

FIG. 8*a* is a box with 4 feet, substantially rectangular, back view. Foot 55 is a foot like the rubber feet similar to what is used on the bottom of counter top kitchen appliances. So even a crate-type box with grating on the back side could have feet attached, so contact to the vertical surface won't mar the often soft siding. The feet are best set closest to the four corners of the box back side, as that brings the most vertical and horizontal stability to a ladder with box embodiment.

FIG. 9 is a box, side (not cross-sectional) view. Curved-cornered back side is on the left. It could be the back side of box 4 of FIG. 6*a*. The sides show no detail, because none is necessary to create a box/ladder embodiment.

2. Description of Even More Embodiments of the Invention

FIG. 10*a* is a box with a pair of blocks, side view. Blocks are on RHS and LHS portions of the box to support LHS and RHS top end of a ladder. Their front surface horizontally supports prior art ladder 77 with its top end caps. Front surface of blocks, like block 8*b* forces the ladder's top end (LHS & RHS top end caps) away from a vertical surface that horizontally supports the box and ladder. A single block could also extend the width (RHS to LHS) of the box (which would then be called a plank). So box front-most top portion, plus blocks, like block 8*b*, together form a partial female cavity for the male rail top end caps. Similarly, the box could have LHS and RHS indents into the sides of the box to form such 'blocks'

FIG. 10*b* is a box with plank 9*b* attached from one side to other side of a box/crate, but a bit down from the box top side. FIGS. 10*a* & 10*b* are easy boxes to make, simply attaching a length of wood, rod of metal, or the like, to a crate. This is but one way to form a female cavity to secure the male top end of a ladder.

FIG. 10*c* shows a box with alternative attachment means, side view. It shows three different means of attaching a box to ladder, that can also be used individually to create a ladder with box embodiment. This box is attached to ladder 89 (like a wooden ladder) by a pair of horizontal posts, like RHS post 97 (attaching ladder rails to sides of a box). Also attached by vertical posts or screws like RHS screw 98. Also attached by box holes, like RHS hole 99 can be for box and ladder attachment, horizontal and vertical support & centering.

Without a box, front portion of ladder end caps support against a vertical surface. FIG. 10*c*1 shows upper post extension end caps, like post extension 78. In other words, a pair of ladder end cap post extensions are male extensions securing in a pair of female holes in a box. So such an altered end cap, along with a prior art crate plus a padded bottom side (which would be the backside against the vertical surface) would create a version of the invention.

A male portion could also be made as an extension or attachment that folds out of a ladder, but locks in place enough such that something like a standard crate (but with smooth backside) could then be placed on top. Such an example is shown in FIG. 10*d*, straight ladder with hinged-out male end xx, side view. This could be hinged similar to an A-frame ladder's fold-out paint tray. This shows the hinged-out male end supporting against top portion 56 of box back side (and inside a female cavity near top wall of box back wall). Ladder also supported by lower upper portions of ladder rails bracing against box bottom wall front portion. So, two distant points of support against the box and vertical surface.

FIG. 10X is a prior art A-frame ladder with hinged-out paint tray, side view, inside somewhat of a box shape. FIG. 10X IS NOT an embodiment. It shows approximately where a prior art paint tray TR would position inside an altered box. Such a tray would require major alteration of a box, plus a way to support the back extension of the tray. However, because there is only ONE in-line point of contact against the ladder (line x), it would be a VERY unstable, and NOT have top end support, just lower upper ladder support. With all the pressure against the tray, the box will tilt till the extension holding TR touches the vertical surface. Therein, this would NOT be an embodiment. A stable arrangement requires two substantially distant lines of support against a vertical surface (Support against the top end, and lower upper portions (at least 1' down) is what can provide good support while keeping box short.)

FIG. 10Xa is FIG. 10X shifting, side view. It shows how with just one line of contact, and that being about 1 foot down from ladder top end, the box can easily tilt, jar off TR, where it then quickly collapses into the vertical surface, and at a very unsafe leaning angle. [A prior art paint tray is perpendicular to an A frame ladder top, approximately one foot down from the ladder top, with supporting brace about 2 ft. down from the ladder top end. The prior art tray brace is so low on the ladder to improve the vertical support against the weight of a paint can.]

FIG. 11*a* is a box, front perspective view, posts 7*y* & 7*z*, and plank 9*x* noted. Plank 9*x* is at least 2" tall & can be 2" deep. That is, these opposite (female/male) types of support can be used together if a ladder top end has holes to mate with the posts.

FIG. 11*b* is a box, front perspective view. If this box were injection molded, plank 9*y* and blocks like 8*y* could be molded like cavities into the box. FIG. 11*c* is a box with just posts, front perspective view. This two-post box is all the securing needed to attach to female holes in a ladder top end, like that shown in Prior Art FIG. 4, or a future art straight ladder with holes in the top of its end caps.

FIG. 12 is a three box assembly, side view. Clips, like clip 20, fixedly attach boxes. Similarly, clips horizontally fixedly attached to box with two clips on the assembly's opposite, unseen side. This assembly forms a step stool. (Clip 20 is also shown clipped between 2 boxes in FIG. 16). The backside of all boxes are the top surfaces in this drawing. An injection molded box always requires a sidewall taper to pull box off the tool core.

FIGS. 14*a*, 14*b*, 14*c*, and 14*d* are various boxes, cross-sectional views. There are near limitless structure designs to create the box part of the invention. Though posts alone can be used to support a closed A-frame ladder, a straight ladder end caps could have holes in them to allow a straight ladder to be supported. FIG. 14*a* is shown in FIG. 14*e* attached to a ladder with future end caps that have holes in the top, side view. Aluminum and fiberglass rails are mostly U-shaped channels, so end caps are added, therein easily altered to have holes in them.

3. Constructing, Placing, and Assembling Box/Ladder Embodiment

A box may be injection molded in a form and manner similar to prior art milk crates or storage crates. Prior Art FIGS. 5*a*, 5*b*, and 5*c*, crates are made with inside side of back wall smooth (S), and grating (G) on outside/back side. This is because, as a storage container, the inside is the needed smooth side. But, for supporting against a wall, backside grating would dig into the vertical surface/soft wood siding. So a box with a smooth or soft backside is preferred. (Same reason they put soft end caps on ladder top ends.) FIG. 13 is a possible grate pattern for an injection-molded box; center cross-sectional RHS view. The boxes back wall's back side is substantially smooth (SM), for placing against a vertical surface. Grating may still be needed for strength, like if the box is alternatively stood on when not on ladder). The inside surface of the back wall can still pull out of the injection mold tool. Interior grating GR is noted. Interior grating can be back-to-front stronger because of inside-corner grid parts. Bins and bolts are drawn as dashed lines in this figure, for comparative structure to other drawings.

FIG. 15*a*-15*c* shows straight ladders with attached box leaning against a vertical surface, side view. FIG. 15*a* shows a ladder leaning at the OSA regulatory agency's recommended 4 up to 1 out, where box back side is vertical/ flat against a vertical surface. This drawing details the vertical surface with lap siding, the front points of which contact the box backside. The horizontal force against the vertical surface is distributed equally between beveled siding layers on the vertical surface. FIG. 15*b* shows a leaning ladder with box where the ladder is at a more severe leaned angle. The box top corner touches vertical surface. More force is placed against one upper layer of such vertical surface siding. FIG. 15*c* shows a leaning ladder that is at less of an angle than OSH recommends, where box bottom corner touches vertical surface. More force is placed against one lower layer of such siding. These figures show a benefit of having box backside curved edges and back rubber-overmolded. Therein the backside of the box promotes the user to lean the ladder at the OSH recommended angle. Incorrect or not-recommended angle of lean can lead to unsafe conditions.

FIG. 16 shows two boxes, positioned for attachment, cross-sectional view. Two boxes attached together allow a user to reach odd places, like overhead eves. First box 4*a* has clips 20 and 21, together capable of fixedly attaching to second box 4*b*, like if 4*b* had holes to receive each clip. Box 4*b* is positioned to receive clips, with 4*b* box back wall facing box 4*a*'s front. FIG. 17 shows two boxes attached with a clip, center cross-sectional view. Box grating is somewhat shown. An attachment means may be accomplished by using clips, which can be hooked-ended pieces of ribbon metal. The T-shaped portion of box grating provides a post-like area for which a hook's end can hook/rotate around. The clips can be pried off by hand. Such clips can be somewhat loosely attached to a box's wall, or molded parts of a box.

Exact grid pattern not claimed. A box may be made more useful by add-ing holes for tools, etc. One such box is shown in FIG. 18, front perspective view. Special-sized holes can be added for caulk gun or drill. A handle (not shown) may be added to carry the box, like if a user filled the box with tools, brought it to the ladder, then dumped the tools out. RHS front surface 8*a*1, LHS front surface 48 are formed by hollow bins that are open on the top side of the box. These hollow cavity/ bins are RHS bin 49 and LHS bin 50. Post holes 51 are for posts, like bolts previously described.

Often a corded tool is needed for a repair up on a ladder, like a sander, drill, screwdriver, etc. Such tools can be attached to, power (electrical or air) that is nearer the ground. Without support of a cord, like a cord catcher, the weight of the cord can fall down or pull an attached tool off the lackey. A cord could be, but is not limited to being, an electric extension cord, rope, an air hose, or any type cord needed by a user on the ladder. The FIG. 18 box has diamond-shaped cut-out hole, identified as cord catch 52. This cord catch in the box side is capable of receiving and fixedly holding folded-over cord 38. Near any cord can be folded over and caught in this diamond-shaped hole. The diamond shape holds the cord in two ways: An electric cord's natural shape is straight, so when the cord is folded over and placed in the diamond shape, it tries to straighten itself, therein press-ing against the outermost areas of the hole (shown as FIG. 18*a*, a detail of FIG. 18, inside box RHS view, cord cross-sectional view. The edges of the hole bite into the cord (top of folded cord 38T and bottom of folded cord 38B), keeping it from pulling out of the hole. A rope placed in the diamond shape would stay put because it would catch in the lowest portion of the hole it could fit in. The size of the diamond shape can catch a variety of different diameter cords because the cord trying to straighten itself within the hole presses/wedges it against the most distant diamond points the cord can fit/dig into. Though one size diamond shape can hold/catch a variety of ropes and cords, a second larger cord catcher would better suit catching cords like an air hose.

Two boxes can be clipped together (as suggested in FIG. 16 and FIG. 17). The back-most hole 53 is for a clip to clip two boxes together. A clip would clip between hole 53 and another box's front hole, like hole 54. (The spaces between the grating can be hollow or solid. The 'holes' 53 and 54 are just marked as an example of where they could be.) A box could look less cross-section/ crate-like, like a top wall raised ring spot to secure a quart of paint, a recessed spot to place a gallon of paint, and a hole for a hammer. Hole 45 could be for a bungee cord's hooked ends (bungee cord for front restraint)

Figure 19A:
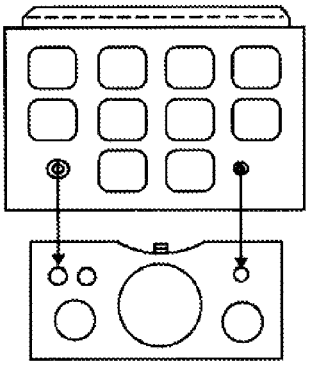
FIG. 19*a* shows how crate box bolts on P.A.
Figure 19B:
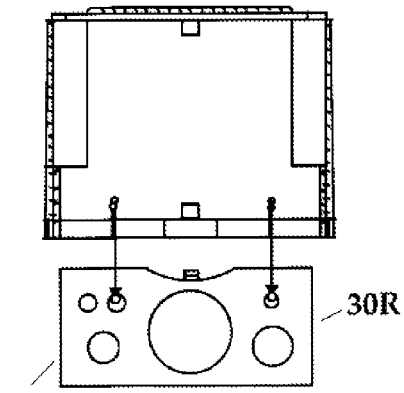
FIG. 19*b* shows how box bolts on a Werner ladder top end, top view
Figure 19C:
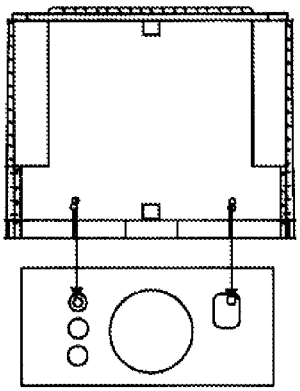
FIG. 19*c* shows how box bolts on a Husky ladder top end, top view
Figure 19D:
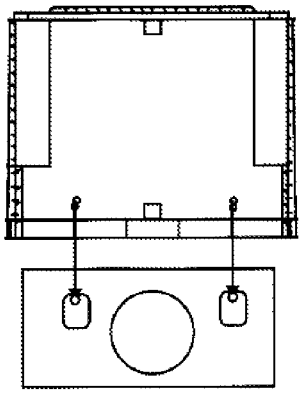
FIG. 19*d* shows how box bolts on a Green Bull ladder top end, top view
Figure 19E:
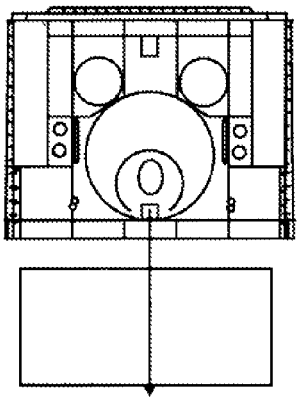
FIG. 19*e* shows how box clips on any ladder top end, top view

FIG. 19*a* shows how a crate box could bolt on P.A. FIG. 4 ladder top end, top view, where the arrows indicate where posts (like posts shown in FIGS. 6*f*, 11*c*, and 14*e*) of the crate fit into the holes on the ladder top end. The design of the crate construction is inconsequential. FIG. 19*b* shows how a box posts mate with holes on a Werner® ladder top end, top view. FIG. 19*c* shows how box posts mate with holes on a Husky® ladder top end, top view. FIG. 19*d* shows how box posts mate with holes on a Green Bull™ ladder top end, top view. FIG. 19*e* shows a fancy box top wall, with the holes/bolts like the other boxes shown in FIGS. 19*a*, 19*b*, 19*c*, and 19*d*. This fancy box has a grid structure to accommodate a gallon or quart paint can, holes for tools, hollow bins on the sides, and other holes for tools. None notated. FIG. 19*e*'s design was disclosed in a prior version of Application, but is inconsequential to new claims. The box can clip on any ladder top end. The design has a front center hole to place a restraining clip, like clip 57*a* that is shown in cross-sectional side view of FIG. 20.

Figure 21A:
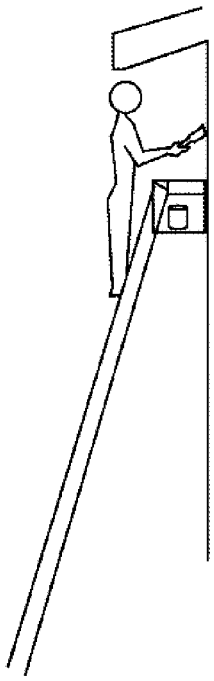
FIG. 21*a* shows a user, straight ladder with one box, side view FIG. 21*b* an incorrectly tilted straight ladder with one box, side view
Figure 21B:
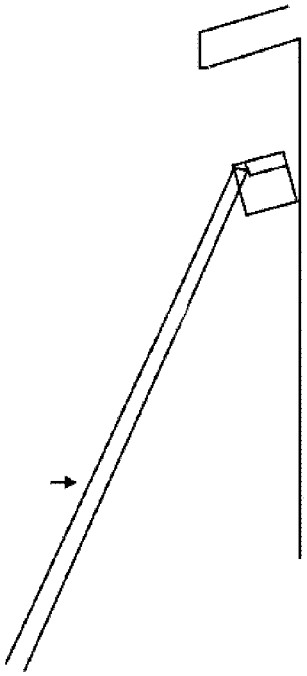
FIG. 21*c* shows a user, straight ladder with no box, side view
Figure 21C:
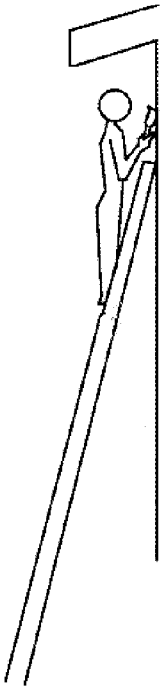

FIG. 21*a* shows a user on straight ladder with one box, side view. FIG. 21*b* an incorrectly tilted straight ladder with one box, side view. Because the box won't sit against the vertical surface flat when the ladder is over-straightened, a user is more likely to adjust the ladder to the correct height to width ratio, and be safer. FIG. 21*c* shows a user, straight ladder with no box, side view. Not only does a user (without a box) have nowhere to place their paint or brushes, they will have to lean sideways to paint and lean backwards to paint the eaves, which is an unsafe position, and causes many ladder accidents.

4. Front Restraint Plus More Embodiments

Figure 22A:
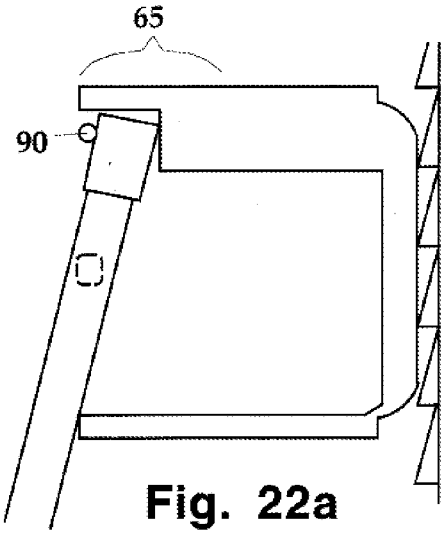
FIG. 22*a* shows a box secured on a straight ladder, side x-sectional view
Figure 22B:
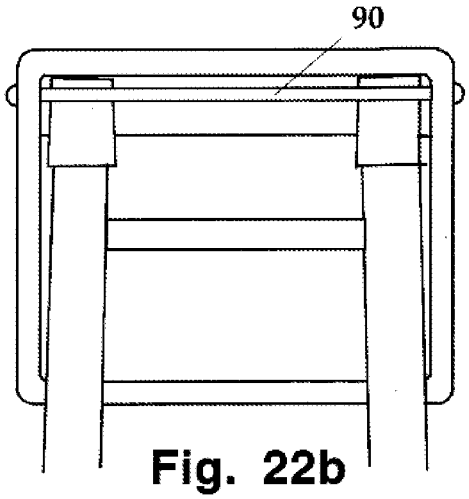
FIG. 22*b* shows the box of FIG. 22*a*, front view

FIG. 22*a* notation 65 shows the front-most top portion of the box shown in FIG. 6*a*, side view. Supporting the top end of a ladder in the front-most top portion distances the top end of the ladder from the vertical wall. Though the male/female type of ladder to box attachment may be different with different embodiments, front-most top portion rests on top of ladder top end. FIG. 22*a* also shows a straight ladder, restrained by restraining rod 90 (rod added to the embodiment also shown in FIG. 6*a*). FIG. 22*b* shows front view of same box on ladder using restraining rod 90. This rod may be secured to the frontward-top-most portions of the box's sides. This restraining rod functions like the front clip for an A-frame ladder. It holds the box on the ladder in place for doing things like lifting or moving the ladder with box. It substantially helps enclose the ladder top end into a more complete female cavity.

Figure 28:
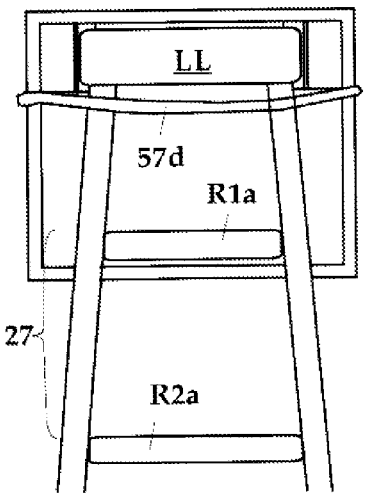
FIG. 28 shows a bungee cord on an A-frame ladder, front view
Figure 29:
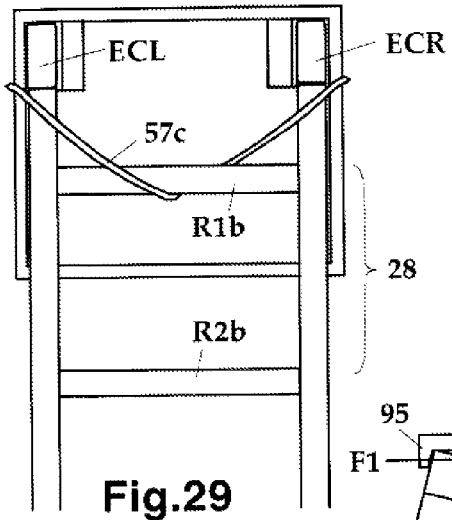
FIG. 29 shows a bungee cord on a straight ladder, front view

FIG. 28 shows a bungee cord 57*b* attached to a box, and confining a closed A-frame ladder against the box, front view. Bungee cord catches under the front side bottom edge of the ladders top platform. This same straight-across bungee cord can also be used on a straight ladder, catching bungee cord under the front side bottom edge of end caps. This bungee cord front restraint is essentially completing a female cavity around ladder top end on either closed A-frame or straight ladder. FIG. 29 shows a bungee cord 57*c* attached to a box, and confining a straight ladder against the box, front view. A bungee cord can be attached by hooking ends onto box holes, or in other unspecified ways. The front restraint is a method of securing ladder top end from moving frontward off of box, like when ladder is moved or jarred.

Figure 30:
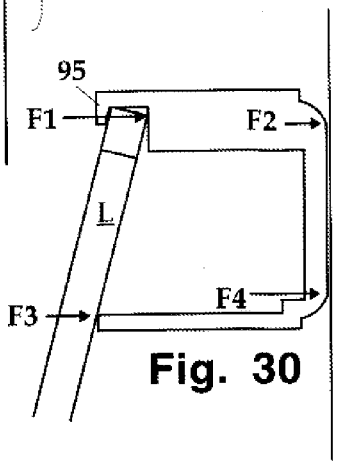
FIG. 30 shows a clip on a straight ladder, side view

FIG. 30 notation 95 is similar to the restraining rod of FIG. 22*a* in how it restrains the ladder. It positions in front of were ladder top end supports. This or other front restraints allow a box to stay positioned on top of the ladder while ladder is in transport (lifted up, taken down, and moved sideways), and essentially provides a more surrounding female cavity. A restraining device can be, but is not limited to being, posts, blocks, a clip, clips, or a bungee cord. Front restraint/device substantially restrains the ladder rearwardly, thereby keeping ladder from moving frontward (96) off the box, to the point ladder top end would dislodge itself from being under the box top, like when ladder is in transition/ being moved. The front restraint/device is more like a seat belt. A front restraint/device lets a user move the ladder with the box securely or semi-securely attached. It also secures the ladder from slipping off the box for ANSI Bottom Slip Test. Straight ladders are required to have enough sure footing to pass the ANSI test. Front restraint more or less completes the female component of a ladder/box embodiment.

Figure 32A:
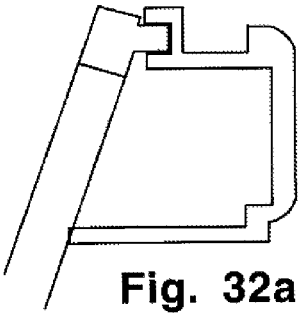
FIG. 32*a* shows a ladder rearward male end, side view
Figure 32B:
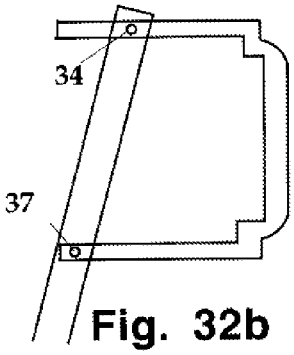
FIG. 32*b* shows a box without side walls, side view

Though semi-enclosed box side walls have been insinuated in all previously-shown boxes, a box does not need them to function with ladder as an embodiment. FIG. 23 shows a bare frame box with blocks, front perspective view. LHS side wall edge 70 and RHS side wall edge 71 confine a prior art ladder from shifting sideways, like if a user were to try to position the box wrong or lean sideways on the ladder in use. In use with a ladder, bottom edge 72 supports against the (lower upper portions of the) backside of a ladder's rails. Ladder top end will be held away from the vertical surface with LHS and RHS surfaces 74 and 75. The box's bottom front edge 72 holds a ladder's lower upper portion farther from a vertical surface than a ladder's top end. The unseen backside 73, is but a fairly HOLLOW rectangle, preferably frictional and padded. Still this hollow rectangular surface area would be enough to set against a vertical surface without marring siding. It's two advantages: It may be lighter in weight than a box with larger-surfaced sides, & shelves may be placed on top and bottom only when desired. FIG. 32*b*, discussed later, also has no side walls (box is mated with ladder with posts, such that ladder RAILS become box vertical structure support. Sideways stability is provided by the width of the box back wall and box substantially flat against a vertical surface provided by back wall height.

FIG. 23*a* shows a notched out bottom 29, front perspective view. The confining center section 84 could confine the INSIDE sides of ladder rails from shifting sideways, (similar to what FIG. 23 does on outside sides of ladder). So center section 84 would center a side-to-side narrower ladder, and outside confining edges, like 40 an outside confining edge would center wider ladders.

FIG. 24 shows a bare frame box with posts, plus 85 notched bottom wall front portion, front perspective view. Posts like post 76 also keep the top of a ladder from moving sideways, lower upper portion of the ladder rails would be confined from shifting sideways by outside confining edges (like outside confining edge 39) and support against notched out area 85, which keeps that portion centered slightly in from the side walls. Left hand and right hand side walls (or side braces) 93L and 93R of the crate are there for but strength. Minimalistic box side, top, bottom, and back walls reduce weight and cost of box. If not stood on as step stool, or supplies aren't needed laddertop, the box doesn't need more structured top, bottom, or back walls.

FIG. 25 shows a box where ladder end caps locks into large holes in box top wall, side view. This embodiment puts outward-backward pressure on the box holes both vertically and horizontally from the end caps (ladder top end). Enforced material of box top wall walls near the end caps may be needed. Lower upper portion of ladder sets in notched out bottom wall, slightly back from bottom wall front edge.

One box can fit ladders with different ladder top ends. FIG. 26*a* through FIG. 27*b* show one box on two different ladders. The box blocks, like hollow bins, form front surfaces. FIG. 26*a* is the box, top cross sectional view, with closed A-frame ladder. FIG. 26*b* is the box, front view, with same closed A-frame ladder. Top end platform 58 noted in both figures. A box 16+" wide inside can fit a closed A-frame ladder top that is about 13.5" wide at the top end, to a straight ladder that is about 16" wide at the top end. Supporting front surfaces have two levels: 61L and 62L are noted in FIG. 2*a*. There is a small dividing peak between the two levels. 61L is slightly higher than 62L so that a narrower A-frame ladder top end (platform) is restricted from sideways play. FIG. 26*a* shows ladder platform 58 confined by level 61L, and opposite side level, being taller than level 62L. Front surface multiple levels. FIG. 27*a* is the same box, top cross sectional view, with straight ladder, and FIG. 27*b* box, front view, with straight ladder. Ladder top end's LHS 59 and RHS 60 sides/end caps noted in both figures. The straight ladder is confined from shifting sideways by top-most portions of the box sides. This design is but one way to allow multiple width ladders to be used with a box.

Stability of ladder with box against wall increases with the distance between top line of force and bottom line of force. These lines of force are shown with the four arrows drawn in FIG. 30. Top end of ladder (end cap) against box F1, and top portion of box back side against vertical surface F2. Lower upper portion of ladder against box bottom wall front portion F3, and bottom portion of box back side against vertical surface F4. All are horizontal forces against the supporting vertical wall. Force F1 is substantially in line with force F2, and force F3 is in line with force F4. Force F1 with force F2 is substantially vertically distant from force F3 with force F4.

Figure 31A:
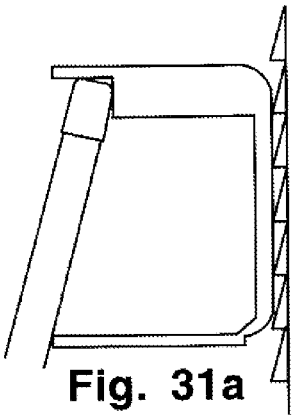
FIG. 31*a* shows an over-elongated box on a straight ladder, side view
Figure 31B:
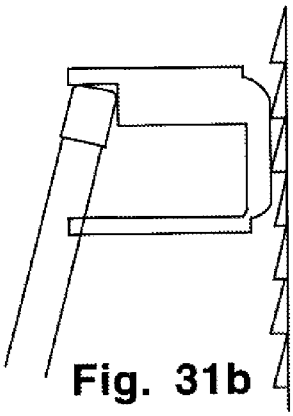
FIG. 31*b* shows an overly short box on a straight ladder, side view

FIG. 31*a* shows an over-elongated box on a straight ladder, side view. Such a top-to-bottom wall taller box would be heavier than a shorter (like 14" tall) box, and the front of the box top wall would extend a bit intrusively over the ladder, as shown. FIG. 31*b* shows an overly short box on a straight ladder, side view. A top-to-bottom wall shorter box would be much less stable against a vertical surface. And, for this design with front surface, the box would need a notched-out bottom wall. The shorter (top to bottom) the box is, the deeper the notched portion of box bottom wall front portion would have to be. Also the inside tray area would be short and harder to store supplies in. 13" top wall to bottom wall is a good height for a box.

For most embodiments, the box can be of a size and shape to fit over a ladder top. Exceptions are shown in FIG. 32*a* & FIG. 32*b*. FIG. 32*a* shows a ladder rearward male end, side view. FIG. 32*b* shows a box without side walls, side view. Side walls are absent, and box is mated with ladder with posts like 34 and 37. The box fits between and is slightly narrower than the ladder rails. Box is supported to the ladder with posts 34 (and similar LHS post) between box top wall and ladder top end caps, and with posts 37 (and similar LHS post) between box bottom wall and ladder lower upper portion. Therein, the ladder itself provides vertical structure supporting front portions of top and bottom wall at set distance from each other. Such an embodiment would require more effort to attach than a box thrown over the top of a ladder. As with all embodiments, ladder top end horizontally supports against top portion of box, and ladder lower upper portion supports against bottom portion of box.

Figure 33:
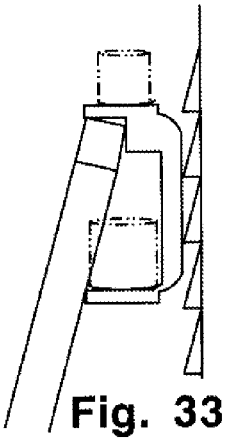
FIG. 33 shows bottom wall deep enough to store paint can, side view

FIG. 33 is a box where bottom wall is deep enough to store a one gallon paint can supported on top side (inside surface) of bottom wall/platform, and a smaller can is supported on top side (outside surface) of top wall, side view. Though it does not distance the ladder far from the wall, it substantially forces a user to position the ladder at the recommended set angle of lean.

5. Common Specifications of the Invention

Figure 34:
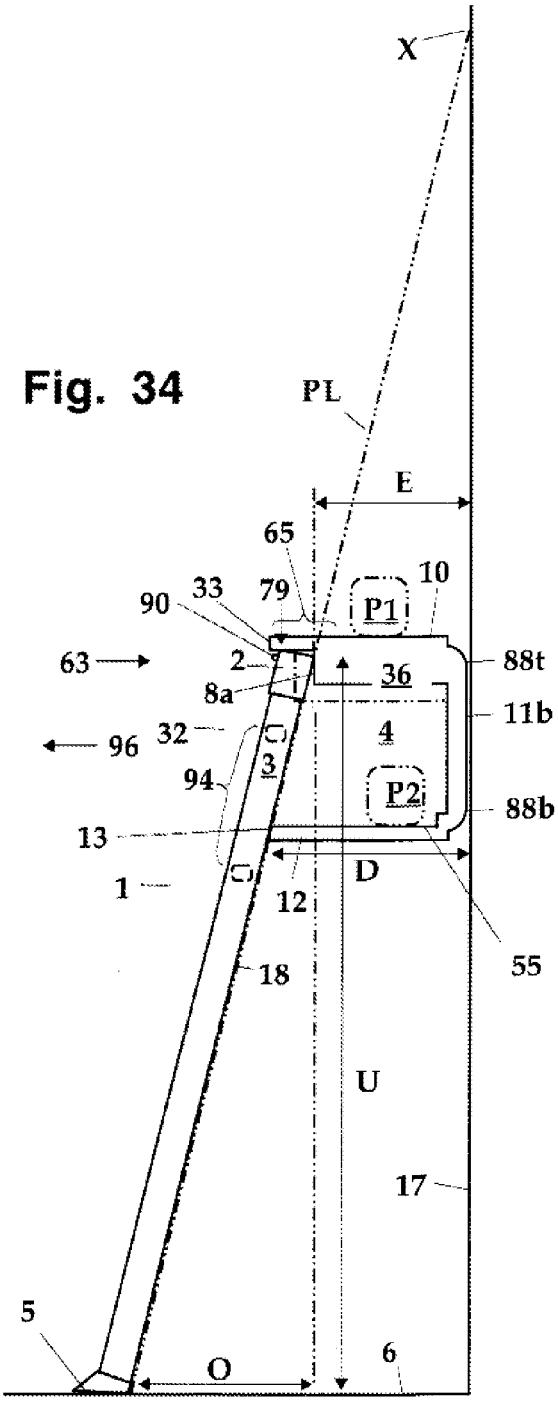
FIG. 34 shows a box on a straight ladder, side view

FIG. 34 shows a box on a straight ladder, side view. The back line of the ladder rails are projected upwards from top end. The upwards projected line PL intersects the vertical surface 17 at a point X substantially higher than the ladder. Calculated from the drawing, with a box that is 14" tall, 0.5" grid wall thickness, and 13" deep (D), the upwards projected line PL is nearly four foot higher than the ladder at top of ladder top end and box top wall.

Figure 35:
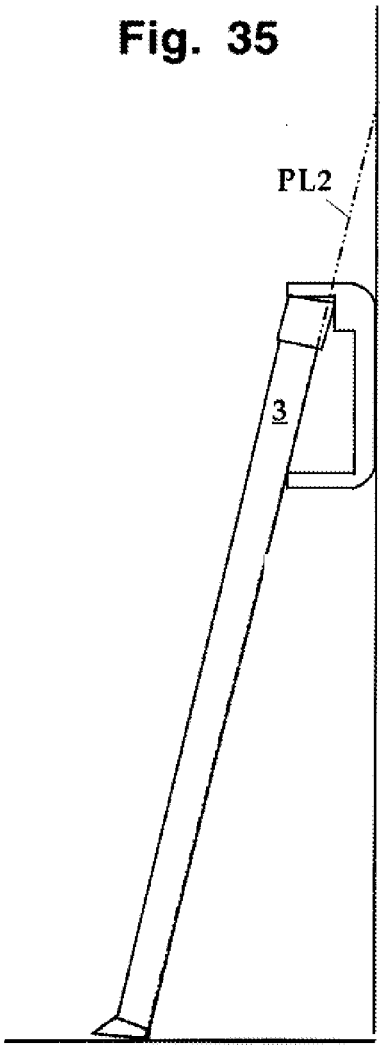
FIG. 35 shows a shallow box on a straight ladder, side view

FIG. 35 shows a shallow box on a straight ladder, side view. The back line of ladder projects upwards from top end, and intersects the vertical surface at a point substantially higher than the ladder. Calculated from the drawing, with a box that is 14" tall, 0.5" wall thickness, and 6" deep, the upwards projected line PL2 is about 1 foot higher than the ladder.

Box interior width can be, but is not limited to being, 16-17" if used for both an A-frame ladder and a straight ladder; narrower if just used for an A-frame ladder. Box interior height (top wall to bottom wall) can be, but is not limited to being 12" or greater. In order to identify what part of ladder supports against bottom wall front portion has been approximated as being between first and second rails (lower upper portion), so claims say "substantially". Box exterior depth can be, but is not limited to being 12" (box depth becomes step height when used as a stool). Box posts may be, but are not limited to being, 2" back (from the front edge of top wall). Planks, blocks, or bin front sides may be, but are not limited to being, 3-4" back (from the front edge of top wall).

FIG. 36*a* shows a user mating a box and ladder top end, side view. FIG. 36*b* shows a user leaning a ladder, side view. FIG. 36*c* ladder supported against box, box against surface, side view. This shows the step by step method of using the invention.

6. Distinguishing Characteristics of the Invention

Items that visibly distinguish the invention from prior art include the box supported on ladder top end, positioned slightly inside a box at front-most top portion, and lower upper portions of ladder supported against bottom wall front portion, such that when ladder leaned against vertical surface box backside also supports substantially flat against that surface. An injection molded box would have a smooth or padded back side of back wall.

7. Materials

The box portion of the invention may be, but is not limited to being, constructed from plastic, wood, metal, fiberglass, or a combination thereof. Posts, if used, may be, but are not limited to being, constructed from plastic, wood, metal, fiberglass or a combination thereof. Planks/blocks, if used, may be, but is not limited to being, constructed from plastic, wood, metal, fiberglass, or a combination thereof. Ladder top end may have, but are not limited to having, end caps constructed from plastic, wood, metal, rubber, fiberglass, or a combination thereof.

8. Unobviousness

Milk crates of a size and shape to make a box have been around at least since milk was sold in bottles and carried in crates. Wood crates and ladders may have been around likely since man started building structures. Since the creation of crates or boxes, others have had the opportunity to screw an old wood straight ladder to a box/crate. FIG. 10*c* showed how an old wooden ladder could be screwed to a wood crate (or metal milk crate or plastic milk crate) in from the side or straight down. Attachment could be screws inserted through crate 80 to ladder 89, horizontally attached through hole 99 or with screw or pin 98). Metal milk crates likely had holes of a size for the top of a straight ladder to protrude partially though, between the metal grid, which would have produced a male-female mating means. Towels could be put against a box backside, like users often wrap towels around ladder end caps. As the advantages of such attachment, and simple attachment at that, are so numerous, the fact that nothing similar has been patented is proof of unobviousness. Ladders are involved in hundreds of thousands of accidents per year. As the invention so improves safety even for those who do not use ladders properly, it certainly solves a long-felt, long-existing, and unsolved need. No other patent found taught an under-the-top-side platform/shelf in combination with a leaning ladder support. No other patent taught supporting a ladder-box combo so the box backside supports flat against a vertical surface. Placing a box oddly on top of a ladder top end certainly produces a most unexpected result.

9. Misc.

Prior art injection molded crates have had interior wall steps, the largest step known, from an interior wall towards the box center is ⅜" within 1" of the box rim. This prior art step has value to strengthen the box rim. No prior art injection molded crate was found to have a step exceeding 1.5", or have a step 3" or more back from a crate lip/edge. Such prior art steps are not far enough from the lip of a crate to position a ladder top end securely and at the proper angle. Such shallow prior art steps are not wall-to-center long enough to stop a ladder from slipping off. RHS & LHS are the abbreviations used for right-hand side & left-hand side respectively. A-frame ladders are shown, and considered to be in all descriptions when leaned, in the closed position, where the rails of the ladder lay substantially parallel to each other.

The front/open side of a box is substantially parallel with the back side/back wall of the box in most boxes, though it is not necessary to function, but if not parallel it would not double as a step stool.

Lower upper portions of a ladder are defined for claims as between the first two rungs of a ladder. (FIG. 34, notation 94) On an A-frame, that's between 12" down from the top platform and 24" to the second rung. Additional cross-bars or rungs added to a ladder, that are not in substantially 1-foot-apart from other rungs, are NOT considered as rungs for this specification or claims. A straight ladder, the top rung is often between 6" to 9" down from the top of the end caps. Essentially, the box supports against the ladder at 2 substantially vertically distant contact points/areas, 1 foot being a substantial distance.

Ladder manufacturers, and manufacturers of ladder accessories (like standoffs) pay high insurance premiums, due to the high volume of ladder accidents. Hardware chain stores rarely buy a single item from a manufacturer, even an item as useful as the invention. So, though using the front side of LHS & RHS bins is the most universal version of the invention, it is highly likely that ladder manufacturers will add holes in the sides or top end caps of a ladder, so that a substantially simple box can be used atop the ladder. As bins, posts, and holes are supporting means in prior art in other type structures, identifying one specific box unnecessarily limits the utility of the invention, much like saying sticky notes are for adhering to a computer or wall. If such identification were required, the following boxes could be dependently claimed: 1. The uppermost portions supporting the top end of the ladder being front sides of a pair of bins fixedly attached to the box; 2. The uppermost portions supporting the top end of the ladder being of a pair of posts fixedly attached to the box; 3. The uppermost portions supporting the top end of the ladder being a pair of holes in box top wall of a size and shape to restrain the ladder's top end; and 4. The uppermost portions supporting the top end of the ladder being a pair of holes in box top wall of a size and shape to restrain the ladder's top end.

10. Conclusion

Male/female is the mating to keep the ladder's top end from collapsing farther into the box. Male/female portions can be formed with posts, bins, planks, pins, a supporting hole in box top wall, ladder top end, altered ladder end caps, a hinged-out ladder portion, or undisclosed means. All boxes provide substantially a rectangular box, 5 walls, front side open/missing (ie, no lid, or tabs to close the box), back side substantially perpendicular to box top and bottom side. Other box sides may also be substantially open. This is a multi-value structure component: 1. Box back wall can support horizontally on a vertical surface, and box top and bottom sides provide substantially level surfaces to support tools and supplies. 2. Box front most top portion, and bottom wall front portion, provide two vertically distant lines of ladder support against a vertical surface. The advantages of this include: A. It presets the angle at which the ladder leans, helping prevent a ladder from being placed too close/too vertical against a vertical surface, B. Stabilizes both the box and the ladder against the vertical surface 3. Provides for a rectangular container that can alternatively be used for storage or a step stool.

There are various means to keep ladder top end slightly inside box and 'propped' away from box backside and the vertical surface, including but not limited to: holes in box top wall to match ladder end caps, posts protruding into box to fit into laddertop platform or altered ladder end caps, inward-protruding surfaces fixedly attached to upper portions of a box, or added hinged-out parts that support against upper portions of a box.

Box is considered for claims to be a substantially rigid structure, as it must support ladder away from vertical surface. A front restraint completes the front side of the female surround. The female front side has no force on it when ladder/box are leaned, but keeps box on ladder while box/ladder in transit. Gravity/the force/weight of the leaned ladder holds ladder horizontally against box (and therein box against vertical surface). Front restraint restrains the ladder from moving frontward off of box.

Boxes described and shown in this specification show a variety of ways the box and ladder can be formed to substantially confine ladder from shifting sideways within box. Including, but not limited to: posts in holes (ladder in box or box in ladder), end caps in box top wall holes, box sides against outside sides of ladder, or front-most bottom side notched out portions (in conjunction with outside confining edge or center section).

11. Description for Claims (FIG. 34)

As stated in BACKGROUND, OSH recommends footing the ladder one meter out for every four meters tall, or one out to four tall. This recommended ladder angle is shown in FIG. 34 as 1 out (O) to 4 up (U). 75.5°. At some future time, OSH, or an agency that regulates ladder safety, may change that recommended angle. As the specific angle is not a requirement for the ladder-box method to function, independent claims state "substantial angle", or "substantially an angle recommended for a leaned ladder" "by a ladder regulatory agency".

Box is substantially rectangular, rigid (as compared to cloth) and substantially has 6 sides, with front side open, facing ladder. The vertical surface is considered HORIZONTAL support, because it keeps the ladder (and box) from falling down into a horizontal position. A ladder's top end can be either an A-frame ladder's platform, or the top-most LHS and RHS ends of a straight ladder (end caps), both considered ladder "top end".

Shown in FIG. 34, the invention is substantially a method to support a ladder (3) with box (4) together leaned against a vertical surface (17) for improved ladder utility and safety, comprising the steps of:

Mating front-most top portion (65) of box (4) with top end (2) of ladder (3); footing (5) the ladder on horizontal ground (6), leaning the ladder with the box at a substantial angle (U to O) against a vertical surface (17), wherein when the ladder with the box are leaning against the vertical wall, the top end of the ladder horizontally supports against front-most top portion of the box, upper portion of box back side (88*t*) horizontally supports against the vertical surface, lower upper portion (94) of the ladder horizontally supports against bottom wall front portion (13) of the box, and lower portion of box back side (88*b*) of the box horizontally supports against the vertical surface.

Method of placing front/open side (32) of a substantially rectangular box (4) over top end (2) of ladder (1); supporting (front-most top portion 65 of the box over the top end of the ladder. Further including the steps of:

forming box top wall (10) and bottom wall (12) substantially perpendicular to box back side (11*b*) (for top side of the top wall supporting supplies (P1), and top side of the bottom wall supporting supplies (P2). (That is, top wall used as a platform, and bottom wall used as a platform when holding supplies.) And for efficiently supporting the ladder away from the vertical surface). The front-most portion (65) of box top wall (10) supported on ladder top end (2). The ladder top end positions substantially inside box. The ladder lower upper portion (94) supports against box bottom wall front portion (13). Leaning the ladder (3) mated with box (4). Wherein, when the ladder with the box supported on the vertical wall, the ladder positioning at a substantial angle of 4-up-to-to-1-out angle (U to O angle) from the box back side (11*b*). Wherein, when the ladder with the box supported on the vertical wall, the ladder positioning at a substantial angle of 4-up-to-to-1-out angle (U to O angle) from the vertical wall (17). The ladder substantially leans at an angle recommended by a ladder regulatory agency. The ladder with the box leaned against an immobile vertical surface substantially confines the ladder from shifting sideways within the box. (EX: FIG. 26*a*, 26*b*, 27*a*, 27*b*, 10*c*1, 10*c*, 6*fd*, 14*e*, 25). The box on the ladder, when supported against vertical wall can: provide two platforms (top side 10 and inside side 55) to place and support supplies (P1 and P2) near ladder top end (top wall) and near ladder lower upper portion (bottom wall); distance (E) from vertical surface; and improve ladder utility and user safety.

A box of a size and shape such that, when box top wall is placed over (mated with) ladder top end, and ladder is footed on ground and leaned at 4-up-to-one-out against a vertical wall, box backside supports substantially flat against the vertical wall. And ladder top end positions/rests a substantial distance from vertical surface.

Figure 20:
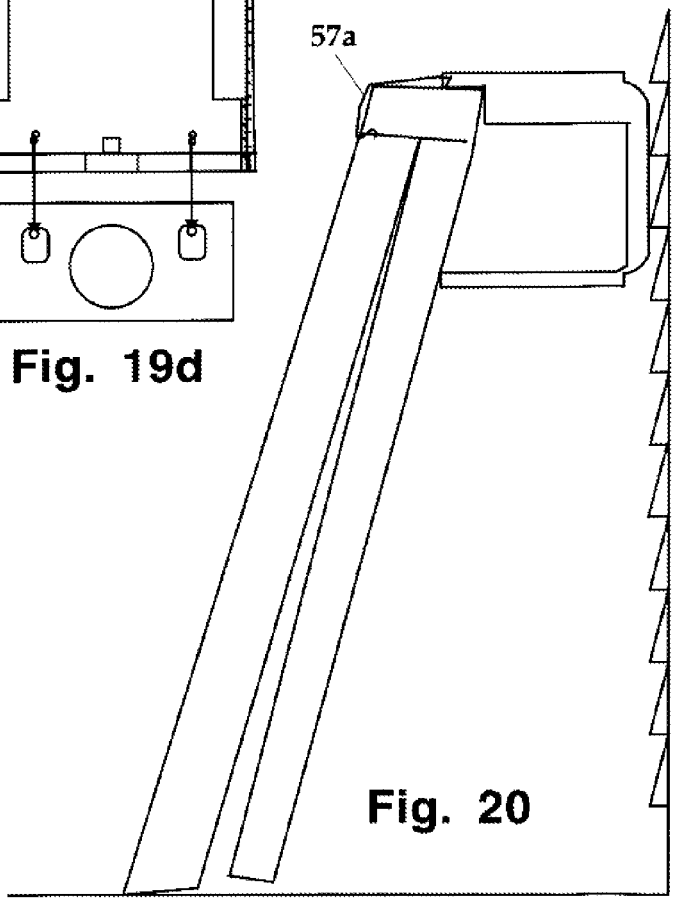
FIG. 20 shows how box clips on any ladder top end, side view

Front restraint (90) is a method of securing ladder top end from moving frontward away from box (4), for when ladder is moved or jarred. Front restraint forms a more complete female cavity. Front restraint can be, but is not limited to being, a bungee cord (FIG. 28 and FIG. 29), post in hole combinations (FIG. 6*fd*, 10*c*1, 10*c*, 14*e*, 25), rod or box overhang (FIG. 22*a*, 22*b*, 30), or restraining clip (FIGS. 20, & 30). "Front restraint" holds the ladder rearwardly (63 rearward direction in FIG. 34) against the box front portion at ladder top end for when/if ladder is moved frontward (96 in FIG. 34).

FIG. 34, notation D is the front-to-back depth of that box. The box top and bottom walls are formed to have a front-to-back depth such that, when ladder with box supported horizontally by vertical surface, upwards projected line (PL) of back side of ladder rails, would intersect vertical surface at a point substantially higher (substantially being at least two feet higher) than ladder top end.

Further including the steps of portions of the box confining the ladder from substantially shifting sideways within the box. Such portions can be, but are not limited to being, post in hole combinations (FIG. 6*fd*, 10*c*1, 10*c*, 14*e*, 25), side walls (FIG. 27*b*), notched out areas creating inside and/or outside confining edges (FIGS. 23*a* and 24), inside surface multiple levels (FIGS. 26*a* and 26*b*), end caps in box holes (FIG. 25), or a hinged-out ladder extensions inside box (FIG. 10*d*).

Further including the steps of forming the top and bottom walls of a front-to-back depth such that, the upwards projected line (FIGS. 34 and 35) from the top end intersects the vertical surface at a point substantially higher (at least 2 feet higher) than ladder top end.

The invention is substantially a box and a ladder with male-female mating supporting them together. Box is weighted down (79) on ladder top end. The box has a substantially open front side (FIG. 6*a* notation 32). In an embodiment, the box can have a right-hand side wall (FIG. 6*e* not. 87), a left-hand side wall (FIG. 6*e* not. 86), a back wall (FIG. 6*a* 11), a top wall (FIG. 6*a* 10), and a bottom wall (FIG. 6*a* 12). The box is of a size and shape to fit over the top-most portions (notation 36 in FIG. 34) of a future art or prior art ladder. When the box is placed over the top-most portion of a ladder (with the box front side facing towards the front side of the ladder), a portion of the a box's uppermost inside portion of the box rests on top of the ladder. And with the ladder being footed on horizontal ground, the box plus the mating means together are of a size and shape to hold the ladder's top end a distance away from a vertical surface on which the ladder is leaned and, when so leaned, the box back wall can rest substantially vertically flat against/parallel to that vertical surface. Mating between box and ladder is the top-most points of contact support between box portions and ladder top end portions.] The female mating portion can be a fixedly attached part of the box, or it might be fixedly attached part of a ladder, and/or vise versa. The mating can be done with posts, blocks, a plank, or combination thereof. The mating between box and ladder positions substantially inside portions of the box.

(FIG. 6*b*) bottom front lip 13 of the box can rest against back side 18. The top end horizontal support can be just a plank or blocks, the box's side walls are of a size and shape to substantially confine the ladder rails (or outside sides, like right-hand outside side 30R and left-hand outside side 30L in FIG. 19*b*, or right-hand outside side 31R and left-hand outside side 31L in Prior Art FIG. 1*b*) from shifting sideways. The box can be of a height to position the bottom wall of the box substantially level with the ladder's first step. Substantially best at 9" or more. The shorter the height, the less leverage/stability the box has against the ladder's back rails.

Box to ladder top end attachment positions inside the box, which includes inside the box walls. Top end attachment often is 3-4" back from the front/open side of a box, compared to bottom wall front portion, which contacts the lower upper portion of the ladder often zero inches back. This leans the ladder at the important substantial angle from the box. The following terminology has been added in case claims must be more descriptive: A box or ladders has proximal (next to/nearest points/centers), medial centers, distal sides, peripheral points away from centers. A box has interior wall surfaces. A box may have five sides, such sides being hollow, grid, solid, or combination thereof, and a sixth side is the open.

Footing the ladder against a vertical surface 1 meter out for every 4 meters tall is considered a substantial angle. The top end of a ladder is considered the ladder top end landing (LL on FIG. 28) on an A-frame ladder, or the ladder rail end caps (ECL & ECR on FIG. 29) for a straight ladder. First rung (R1*a* on FIG. 28) of an A-frame ladder is the step below the ladder top end landing, and its 2nd rung is the step generally one foot down from that (like 2nd rung R2*a* on FIG. 28). First rung (R1*b* on FIG. 29) of a straight ladder is often 6-9" below the end caps, and its 2nd rung is the step generally one foot down from that (like 2nd rung R2*b* on FIG. 29). * For claims, lower upper portion of ladder is between first and second rungs, notated in FIG. 28 as lower upper portion 27 and in FIG. 29 as lower upper portion 28**. Substantially area between first and second rung. The lower contact point of the box is between first and second rungs.

A box is preferred light in weight because it is attached to the ladder before lifting and leaning the ladder. Having top and bottom of box extend the same distance forward allows the box to be alternately used as a step stool.

Supporting ladder top end "a substantial distance away" can be defined as wall top box being at least front-to-back deep enough to support a cylindrical gallon paint can on inside side of bottom wall. The ladder top end positions often about 2-4" closer to the box back side than the ladder's lower upper portion. Though an A-frame platform can have a spot for a paint can, even if the platform were made deep enough to hold a gallon can, a folded A-frame has no "box substantially flat against the vertical surface". Though the greatest advantage of the invention revolves around distancing the top of the ladder away from the vertical surface, having "box substantially flat against the vertical surface" and "at least front-to-back deep enough to support a cylindrical gallon paint can on bottom wall" is still an invention, as it still stabilizes and pads the ladder against a vertical surface, properly leans the ladder 1-to-4, provides safe storage of a paint can, AND BOX CAN BE LIFTED OFF. This fact is important to ladder regulations.

The box is supported against the vertical surface by the ladder and box together weighted (leaned) towards the vertical surface (plus weighted with the user), and the ladder is supported away from the vertical surface by the horizontal (front to back) strength of the box.

With the width of an A-frame and straight ladder having substantially similar lower upper portion widths, a box having substantially a 16" inside width (from RHS to LHS) would substantially restrain a ladder from shifting sideways within the box. "Top end" is the end cap area of a ladder.

CLAIM: A method of horizontally supporting a ladder with a box together against a substantially vertical surface, comprising the steps of: (1) Mating front-most top portion of a box with top end of a ladder (FIG. 36*a*); (2) footing the ladder on horizontal ground (FIG. 36*b*), (3) leaning the ladder (FIG. 36*b*) towards a vertical surface, and then, with ladder leaned at a substantial angle (FIG. 36***c*), (4) horizontally supporting the top end against the box, and horizontally supporting back side of the box substantially flat against the vertical surface.

Though steps 1-3 are generally the easiest order in which to accomplish the invention, they could be done out of order, especially with a ladder short enough to place the box on while holding a partially leaned ladder. However, step 4 is always the last step of these 4 steps. *Only the ladder is claimed leaned, for up till the box is against the vertical wall, the box may be at another angle, or straight up and down. step 3 is the act of leaning the ladder, but  substantiates that the angle of lean has been achieved, and that is where the ladder supports against the box and box supports against vertical surface.

DEPENDENT CLAIM "Further including the steps of: horizontally supporting top end of the ladder against upper portion of the box, horizontally supporting upper portion of back of the box against the vertical surface, and horizontally supporting lower upper portion of the ladder against bottom wall front portion of the box." This defines that the top end of the ladder and lower upper portion of the ladder support against the box and wall at vertically distant points/lines.

CLAIM: "A method of horizontally supporting a ladder with a box against a' substantially vertical surface, comprising the steps of:

vertically supporting front-most top portion of a box with a ladder at top end of the ladder, footing the ladder on substantially horizontal ground, leaning the top end at a substantial angle towards a vertical surface, then horizontally supporting the top end against the front-most top portion, horizontally supporting lower upper portions of the ladder against bottom wall front portions of the box, and supporting back side of the box horizontally and substantially flat vertically against the vertical surface." The weight of the box is supported on the ladder top end. Supported at front-most top portion of box. AND, when ladder is leaned, the ladder top is also supported horizontally against front-most top portion. So front-most top portion provides both vertical and horizontal support components.

CLAIM: "A method of horizontally supporting a ladder with a box against a substantially vertical surface, comprising the steps of: placing top wall of a box over top end of a ladder, footing the ladder on substantially horizontal ground, and leaning the ladder top end at a substantial angle towards a vertical surface, then the top end horizontally supporting against the box, and back side of the box horizontally supporting substantially flat vertically against the vertical surface." In most described embodiments, the box is placed over the ladder top end.

"The method of Claim A, further including the steps of: placing and supporting front-most top portion of the top wall on the ladder top end, horizontally supporting the top end against uppermost portions of the box, and horizontally supporting lower upper portions of the ladder against bottom wall front portions of the box." This dependent claim specifies more specific areas of support between ladder, box, and vertical surface.

I claim:

1. A method of horizontally supporting a ladder with a box together against a substantially vertical surface, comprising the steps of: Mating front-most top portion of a box with top end of a ladder; footing the ladder on horizontal ground, leaning the ladder towards a vertical surface, and then, with ladder leaned at a substantial angle, horizontally supporting the top end against the box, horizontally supporting back side of the box substantially flat against the vertical surface, and horizontally supporting lower upper portion of the ladder against bottom wall front portion of the box.

2. The method of claim 1, wherein when mating the front-most top portion of the box with the top end of the ladder, the ladder is substantially parallel railed.

3. The method of claim 2, wherein the mating substantially: to restrain the ladder rearwardly, for keeping ladder from moving frontward off the box when ladder is being moved, for keeping the ladder from shifting sideways with the box, and for supporting the ladder top away from box backside and the vertical surface when ladder with box leaned against the vertical surface.

4. The method of claim 2, wherein the mating substantially to support the ladder from collapsing horizontally towards the vertical surface; keep the ladder from shifting sideways within the box; and to keep the box from moving frontward off the ladder while ladder is being leaned.

5. The method of claim 4, wherein said mating completed with an accessory part attached to the box, the accessory part being a front restraint for rearwardly securing the ladder against the box.

6. The method of claim 2, further including the steps of:

after said horizontally supporting back side of the box substantially flat against the vertical surface, placing and supporting supplies on upper/outside portion of top wall of the box and placing and supporting supplies on the inside/upper portion of bottom wall of the box.

7. The method of claim 2, further including the steps of:

forming exterior of the box substantially rectangular, the box front side formed substantially open, and the front side facing the ladder when said mating front-most top portion of the box with top end of the ladder.

8. The method of claim 2, further including the steps of: forming a substantially diamond shaped cut-out hole in the box, on a box side, folding a naturally straight shaped cord over to form a folded-over cord, placing the folded-over cord in the diamond-shaped cut-out hole, such that as the cord tries to straighten itself, the folded-over cord presses against the outer-most areas of the hole, such that the hole is capable of receiving and fixedly holding the folded-over cord.

9. The method of claim 2, wherein the box includes an accessory part to complete said mating.

10. A method of horizontally supporting a substantially parallel-railed ladder with a box together against a substantially vertical surface, comprising the steps of:

mating top end of a ladder with front-most top portion of a box; footing the ladder on horizontal ground, leaning the ladder towards a vertical surface, and then, with ladder leaned at a substantial angle, horizontally supporting back side of the box substantially flat against the vertical surface, horizontally supporting the top end against the box, and horizontally supporting lower upper portion of the ladder against bottom wall front portion of the box, such that the box holds the ladder top at a substantial distance away from the vertical surface on which the ladder is leaned.

11. A The method of claim 10, wherein the mating substantially to support the ladder from collapsing horizontally towards the vertical surface; keep the ladder from shifting sideways within the box; and to keep the box from moving frontward off the ladder while ladder is being leaned.

12. The method of claim 10, wherein said mating completed with an accessory part attached to the box, the accessory part being a front restraint for rearwardly securing the ladder against the box.

13. The method of claim 10, further including the steps of, after said horizontally supporting back side of the box substantially flat against the vertical surface, placing and supporting supplies on upper/outside portion of top wall of the box and placing and supporting supplies on the inside/upper portion of bottom wall of the box.

14. The method of claim 10, further including the steps of: forming exterior of the box substantially rectangular, and when mated with the top end of a ladder, the box front side formed substantially open, and the front side facing the ladder when said mating front-most top portion of the box with top end of the ladder.

15. The method of claim 10, further including the steps of: forming a substantially diamond shaped cut-out hole in the box, on a box side, folding a naturally straight shaped cord over to form a folded-over cord, placing the folded-over cord in the diamond-shaped cut-out hole, such that as the cord tries to straighten itself, the folded-over cord presses against the outer-most areas of the hole, such that the hole is capable of receiving and fixedly holding the folded-over cord.

16. A method of horizontally supporting a ladder with a box together against a substantially vertical surface, comprising the steps of: Mating front-most top portion of a box with top end of a ladder; footing the ladder on horizontal ground, leaning the ladder towards a vertical surface, and then, with ladder leaned at a substantial angle, horizontally supporting the top end against the box, and horizontally supporting back side of the box substantially flat against the vertical surface.

17. A method of claim 16, wherein, when the box and the ladder are mated, the ladder is substantially parallel-railed; further including the steps of: horizontally supporting top end of the ladder against upper portion of the box, horizontally supporting upper portion of back of the box against the vertical surface, horizontally supporting lower upper portion of the ladder against bottom wall front portion of the box, and horizontally supporting lower portion of back of the box against the vertical surface.

* * * * *